US012669130B2

(12) United States Patent
Hiroe et al.

(10) Patent No.: US 12,669,130 B2
(45) Date of Patent: Jun. 30, 2026

(54) CONTROL DEVICE THAT DETECTS SURGING

(71) Applicant: MITSUBISHI HEAVY INDUSTRIES, LTD., Tokyo (JP)

(72) Inventors: Takaharu Hiroe, Tokyo (JP); Minoru Matsuo, Tokyo (JP); Tatsuo Ishiguro, Tokyo (JP); Akihiro Nakaniwa, Tokyo (JP); Yasunori Tokimasa, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 492 days.

(21) Appl. No.: 18/013,092

(22) PCT Filed: Nov. 2, 2021

(86) PCT No.: PCT/JP2021/040393
§ 371 (c)(1),
(2) Date: Dec. 27, 2022

(87) PCT Pub. No.: WO2022/113666
PCT Pub. Date: Jun. 2, 2022

(65) Prior Publication Data

US 2023/0146834 A1 May 11, 2023

(30) Foreign Application Priority Data

Nov. 27, 2020 (JP) ..... 2020-196891

(51) Int. Cl.
*F04D 27/02* (2006.01)
*F04D 25/06* (2006.01)
*F04D 27/00* (2006.01)

(52) U.S. Cl.
CPC ..... *F04D 27/0292* (2013.01); *F04D 25/06* (2013.01); *F04D 27/001* (2013.01);
(Continued)

(58) Field of Classification Search
CPC ..... F04B 49/065; F04D 25/06; F04D 27/001; F04D 27/004; F04D 27/0223;
(Continued)

(56) References Cited

U.S. PATENT DOCUMENTS

2005/0154479 A1* 7/2005 Narayanan ..... F04D 27/0284 700/75
2006/0101824 A1 5/2006 Takeda et al.
(Continued)

FOREIGN PATENT DOCUMENTS

CN 1796746 A 7/2006
CN 104081057 A 10/2014
(Continued)

OTHER PUBLICATIONS

International Search Report issued in Application No. PCT/JP2021/040393 mailed on Dec. 21, 2021 (4 pages).

*Primary Examiner* — Charles G Freay
*Assistant Examiner* — Joseph S. Herrmann
(74) *Attorney, Agent, or Firm* — Osha Bergman Watanabe & Burton LLP

(57) ABSTRACT

A control device includes: a variation command unit that changes a command value, which is a command value sent to a system including a compressor, affecting an operating state of the compressor; a proportional coefficient calculation unit that calculates a proportional coefficient of a variation in a parameter, which indicates a state of the compressor or an electric motor that drives the compressor when the system is operated based on the command value, with respect to the command value; and a control unit that performs control for avoiding or suppressing surging in the compressor, based on a value of the proportional coefficient.

4 Claims, 10 Drawing Sheets

(52) U.S. Cl.
CPC ..... *F04D 27/0223* (2013.01); *F04D 27/0261* (2013.01); *F04D 27/0246* (2013.01)

(58) Field of Classification Search
CPC ..... F04D 27/0292; F04D 27/0246; F04D 27/0261; F25B 49/022; F25B 2600/2501; F25B 2600/025
USPC ..... 700/282
See application file for complete search history.

(56) References Cited

U.S. PATENT DOCUMENTS

| | | | | |
|---|---|---|---|---|
| 2006/0147301 | A1* | 7/2006 | Ueda | F04D 27/0207 415/144 |
| 2009/0297333 | A1* | 12/2009 | Mirsky | F04D 27/0261 415/36 |
| 2014/0219820 | A1 | 8/2014 | Koki et al. | |
| 2014/0363269 | A1 | 12/2014 | Takeda et al. | |
| 2018/0209341 | A1 | 7/2018 | Nakahara et al. | |
| 2019/0010949 | A1 | 1/2019 | Swindlehurst et al. | |

FOREIGN PATENT DOCUMENTS

| | | | | |
|---|---|---|---|---|
| CN | 107849981 | A | | 3/2018 |
| CN | 110998100 | A | | 4/2020 |
| JP | 62195492 | A | | 8/1987 |
| JP | H06-034195 | U | | 5/1994 |
| JP | 06272695 | A | * | 9/1994 |
| JP | H06272695 | A | * | 9/1994 |
| JP | H11-342432 | A | | 12/1999 |
| JP | 4191560 | B2 | | 12/2008 |
| WO | 2013/051559 | A1 | | 4/2013 |

* cited by examiner

CONTROL DEVICE THAT DETECTS SURGING

TECHNICAL FIELD

The present disclosure relates to a control device, a control method, and a storage medium storing a program. The present application claims priority based on Japanese Patent Application No. 2020-196891 filed in Japan on Nov. 27, 2020, the contents of which are incorporated herein by reference.

BACKGROUND ART

It is known that a centrifugal compressor used in a turbo compressor or a centrifugal chiller severely vibrates when a flow rate is reduced in a state in which the front-rear differential pressure of the compressor is high. This phenomenon is called surging. When surging occurs, not only the efficiency of the compressor is reduced, but also the compressor may be damaged. For this reason, the centrifugal compressor needs to be controlled by a control device used for avoiding surging. The control for avoiding surging includes two functions, that is, a function of detecting surging and a function of changing an operation condition of the compressor. The function of changing the operation condition of the compressor is a function of changing the operation condition of the compressor from a high differential pressure and a small flow rate to a small differential pressure and a large flow rate. For example, a circulation flow pipe that connects a high-pressure pipe connected to a discharge side of the compressor and a low-pressure pipe connected to a suction side of the compressor is provided, and a circulation flow rate of fluid such as refrigerant, which flows from the high-pressure pipe to the low-pressure pipe through the circulation flow pipe, is increased. As a result, the discharge side pressure of the compressor is reduced, the flow rate of the fluid is increased by the amount corresponding to the circulation flow, and surging is avoided. The circulation is not essential, and for example, in the case where the fluid is air, the air is generally discharged from the pipe on the discharge side of the compressor.

Among the work that the compressor does on the fluid, the work corresponding to the circulation flow rate is a loss because it only heats the fluid without being used for the original purpose such as chilling. Therefore, the circulation flow rate is required to be the minimum necessary. In order to minimize the circulation flow rate, first, the detection accuracy of surging is important. The detection of surging of a compressor is generally performed based on the flow rate of fluid, which is compressed by the compressor, and the discharge pressure of the compressor (or the pressure ratio between the suction side and the discharge side of the compressor) (PTL 1). A drive current of a motor may be monitored instead of the flow rate of the fluid (PTL 2).

Here, a description will be made with reference to FIG. 10. An example in FIG. 10 is a characteristic curve of a compressor. In the graph in FIG. 10, the longitudinal shaft represents discharge pressure (or a compression ratio) of the compressor, and the lateral shaft represents a flow rate of fluid. A surge line L1 indicates a boundary line between an operation region where surging occurs and an operation region where surging does not occur in a relationship between the discharge pressure and the flow rate of the compressor. Surging is an abnormal operating state that occurs when the flow rate of the fluid is reduced in the compressor. When an operating point of the compressor has a relationship of the flow rate with the discharge pressure included in the region on the left side of the surge line L1, that is, when the operating point of the compressor has high-pressure (or high differential pressure) and a small flow rate, surging is more likely to occur. The region on the left side of the surge line L1 is referred to as a surging region. When the operation condition of the compressor enters the surging region, the circulation flow regulation valve, which is provided in the circulation flow pipe, is opened to lower the discharge pressure or the pressure ratio, and the flow rate of the fluid is increased, and then the operation condition is shifted to the lower right region of the surge line L1 where no surging occurs.

The accuracy of the surge line L1 is important in this control. When the surge line L1 is inaccurate, there is a probability that an extra fluid must be circulated by the amount of the error. This cannot reduce the loss of work of the compressor. The cause of the error will be described. A surge line L2 in FIG. 10 is a surge line that has changed from L1 after the operation time has elapsed due to dirt inside the compressor or the like. Such a change strongly depends on the performance deterioration due to the operation time of the compressor, the operation history, or the like. Since the surge line L2 cannot be defined in advance without an error, the compressor generally allows a loss and operates by opening a circulation flow regulation valve or the like before the surging occurs. As a response to an error of the surge line L2, for example, PTL 3 discloses a technique of detecting the occurrence of surging from variations in discharge pressure and a drive current of the compressor in consideration of the passage of the operation time. However, the frequency or amplitude when the discharge pressure or the flow rate (or the drive current) is changed is determined not only by the properties of the compressor alone, but also depend on the dimensions of the pipe connected to the compressor, the volume of the container connected to the pipe, the temperature or composition of the fluid, the flow regulation valve of the bypass pipe, and the like. For this reason, it is difficult to define a threshold value for determining the occurrence of surging with respect to variations in the discharge pressure or the flow rate.

Normally, on the suction side of the compressor, the fluid does not receive the work of the compressor, and the fluid on the discharge side is the fluid that receives the work of the compressor. As a result, the temperature of the fluid on the suction side of the compressor is lower than that on the discharge side. However, when surging occurs, the flow of the fluid is changed, and a phenomenon occurs in which the fluid subjected to the work of the compressor flows back to the suction side. Thereafter, the temperature of the fluid rises on the suction side of the compressor. PTL 2 discloses a technique in which a temperature sensor is attached to a suction side of a compressor, the rise in the fluid temperature on the suction side as a result of flow back due to surging is monitored, and false detection of surging is avoided by using the above property. However, in the method in PTL 2, the occurrence of surging cannot be detected only after the variation is increased to such an extent that flow back occurs.

CITATION LIST

Patent Literature

[PTL 1] Japanese Unexamined Patent Application Publication No. 62-195492
[PTL 2] Japanese Patent No. 4191560
[PTL 3] International Publication No. 2013/051559

SUMMARY OF INVENTION

Technical Problem

There is a demand for a technique for reliably detecting and handling surging at a stage where surging is minor.

The present disclosure provides a control device, a control method, and a storage medium storing a program capable of solving the above-described problems.

Solution to Problem

A control device of the present disclosure includes: a variation command unit that changes a command value, which is a command value sent to a system including a compressor, affecting an operating state of the compressor; a proportional coefficient calculation unit that calculates a proportional coefficient of a variation in a parameter, which indicates a state of the compressor or an electric motor that drives the compressor when the system is operated based on the command value, with respect to the command value; and a control unit that performs control for avoiding or suppressing surging in the compressor, based on a value of the proportional coefficient. Alternatively, the control device of the present disclosure may include a detection unit that detects surging in the compressor based on the value of the proportional coefficient, instead of the control unit.

A control method of the present disclosure includes: changing a command value, which is a command value sent to a system including a compressor, affecting an operating state of the compressor; calculating a proportional coefficient of a variation in a parameter, which indicates a state of the compressor or an electric motor that drives the compressor when the system is operated based on the command value, with respect to the command value; and performing control for avoiding or suppressing surging in the compressor, based on a value of the proportional coefficient.

A non-transitory computer-readable storage medium storing a program of the present disclosure causes a computer to execute a process of changing a command value, which is a command value sent to a system including a compressor, affecting an operating state of the compressor, calculating a proportional coefficient of a variation in a parameter, which indicates a state of the compressor or an electric motor that drives the compressor when the system is operated based on the command value, with respect to the command value, and performing control for avoiding or suppressing surging in the compressor, based on a value of the proportional coefficient.

Advantageous Effects of Invention

According to the control device, the control method, and the storage medium described above, surging can be detected and handled quickly and reliably.

DESCRIPTION OF EMBODIMENTS

Hereinafter, surging control according to each embodiment will be described in detail with reference to FIGS. 1 to 11.

First Embodiment (Configuration of Chilling System)

Figure 1:
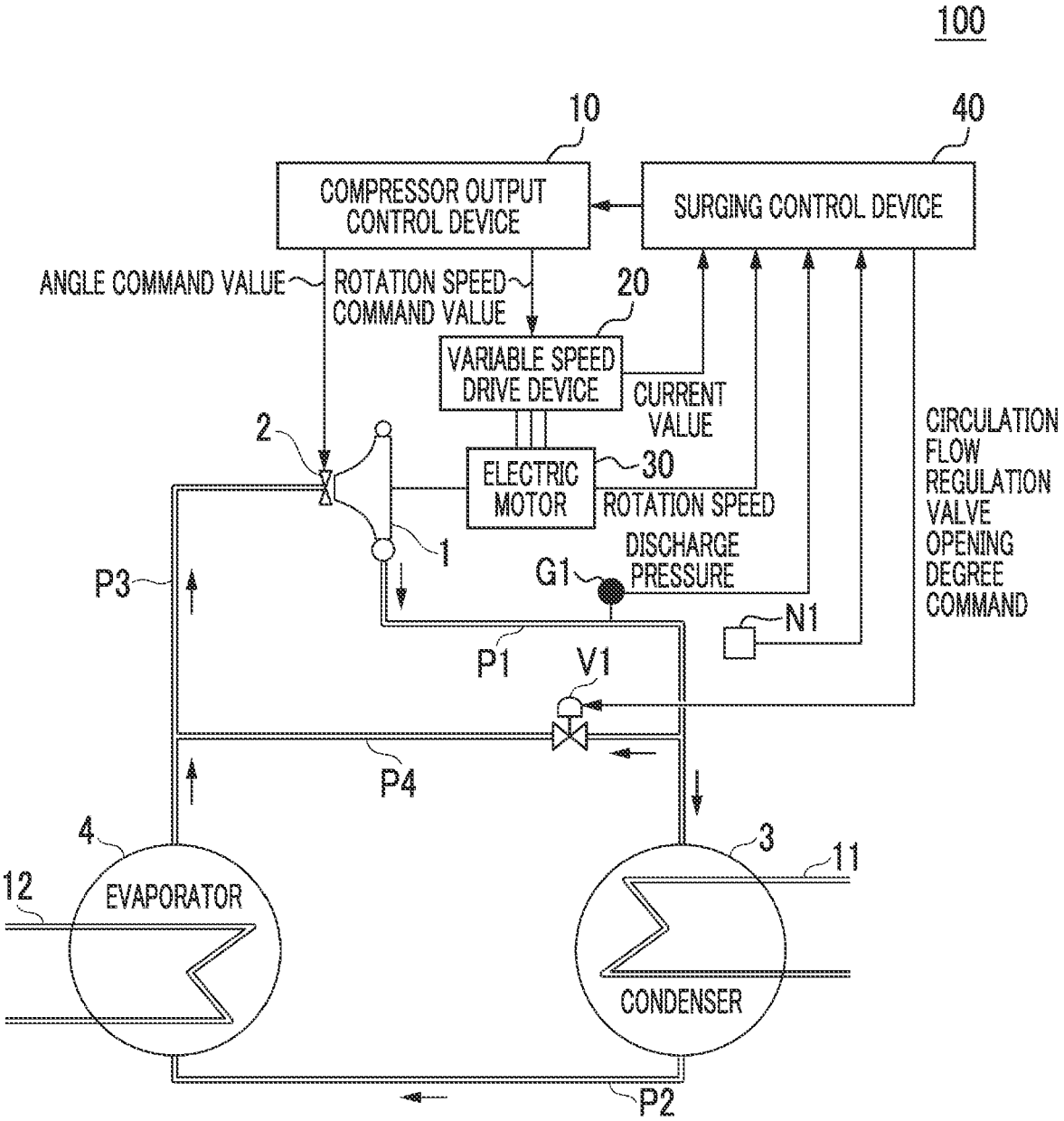
FIG. 1 is a diagram showing an example of a chilling system according to a first embodiment.

FIG. 1 is a diagram showing an example of a chilling system according to a first embodiment.

As shown in FIG. 1, the chilling system 100 includes a compressor 1, an inlet guide vane 2, a condenser 3, an evaporator 4, pipes P1, P2, and P3, a circulation flow pipe P4, a circulation flow regulation valve V1, a pressure sensor G1, a compressor output control device 10, a variable speed drive device 20, an electric motor 30, and a surging control device 40. The pipe P1 connects a discharge side of the compressor 1 and the condenser 3. The pipe P2 connects the condenser 3 and the evaporator 4. The pipe P3 connects the evaporator 4 and a suction side of the compressor 1. The circulation flow pipe P4 connects the pipe P1 and the pipe P3. The circulation flow pipe P4 is provided with a circulation flow regulation valve V1 for adjusting a flow rate of refrigerant flowing through the circulation flow pipe P4. A rotary meter that measures a rotation speed may be attached to the compressor 1 or the electric motor 30. A vibration meter may be attached to a main body, a rotation shaft, a bearing, or the like of the compressor 1 or the electric motor 30. A flow meter that measures the flow rate of the refrigerant may be attached to the pipe P1 on the discharge side of the compressor 1. In order to monitor the pressure ratio, a pressure sensor that measures the pressure of the refrigerant may be provided in the pipe P3 on the suction side of the compressor 1. A noise meter N1 may be attached to the chilling system 100.

The compressor 1 compresses the refrigerant and discharges the high-temperature and high-pressure refrigerant. The compressor 1 is connected to the electric motor 30 and is driven by the electric motor 30. The compressor output control device 10 outputs a rotation speed command value, which is sent to the compressor 1, to the variable speed drive device (inverter) 20. As will be described later, in the present embodiment, in order to detect the occurrence of surging, the rotation speed command value is slightly changed and the response thereof is monitored. The variation in the rotation speed command value is commanded by the surging control device 40. The variable speed drive device 20 supplies a current, which is based on the rotation speed command value, to the electric motor 30 and drives the electric motor 30, and the electric motor 30 drives the compressor 1 at a rotation speed, which is based on the rotation speed command value. The inlet guide vane (IGV) 2 is provided on the suction side of the compressor 1. The inlet guide vane 2 is controlled by the compressor output control device 10. The compressor output control device 10 outputs an angle command value to the inlet guide vane 2. The inlet guide vane 2 adjusts the angle of a guide vane based on the angle command value and adjusts the flow rate of the refrigerant sucked into the compressor 1. The pressure sensor V1 is provided in the pipe P1 on the discharge side of the compressor 1, and the pressure sensor G1 measures the refrigerant pressure on the discharge side of the compressor 1. The noise meter N1 measures noise such as vibration noise or abnormal noise generated from the compressor 1, the inlet guide vane 2, the pipe P1, and the like.

The refrigerant, which is discharged by the compressor 1, is supplied to the condenser 3. The condenser 3 condenses a high-temperature and high-pressure refrigerant. A pipe 11 is connected to the condenser 3, and cooling water is supplied to the pipe 11 from a cooling tower (not shown). In the condenser 3, heat exchanging occurs on the refrigerant with the cooling water flowing through the pipe 11. The refrigerant condenses by dissipating heat to the cooling water. The refrigerant, which is condensed by the condenser 3, is decompressed by an expansion valve (not shown) provided in the pipe P2. The decompressed low-pressure refrigerant is supplied to the evaporator 4. The evaporator 4 evaporates the low-pressure refrigerant. A pipe 12 is connected to the evaporator 4, and chilled water is supplied to a load (not shown) through the pipe 12. In the evaporator 4, heat exchanging occurs on the refrigerant with the chilled water flowing through the pipe 12. The refrigerant cools the chilled water supplied to the load side, and the refrigerant vaporizes by absorbing heat from the chilled water. The vaporized gas phase refrigerant is sucked into the compressor 1 after the flow rate is adjusted by the inlet guide vane 2 and is compressed again by the compressor 1. The refrigerant circulates in the refrigerant circuit in this way.

The surging control device 40 acquires parameters such as a current value supplied from the variable speed drive device 20 to the electric motor 30, a refrigerant pressure measured by the pressure sensor V1, or a rotation speed, vibration, vibration of a shaft and bearing of the compressor 1, as well a rotation speed, a current consumption, a power consumption, vibration, vibration of a shaft and bearing of the electric motor, a flow rate of refrigerant, a pressure ratio of the refrigerant before and after the compressor 1, and periphery noise, monitors a response with respect to variation in the rotation speed command value for at least one of these parameters, and determines an occurrence status of surging. When surging occurs, the surging control device 40 outputs an opening degree command to a circulation flow regulation valve V1. For example, the circulation flow regulation valve V1 is normally closed, and when surging occurs, it is controlled to open by an opening degree command from the surging control device 40. When the circulation flow regulation valve V1 is opened, a part of the refrigerant discharged by the compressor 1 is sucked into the compressor 1 again through the pipe P1, the circulation flow pipe P4, and the pipe P3. As a result, the flow rate of the refrigerant flowing through the compressor 1 increases, the discharge pressure of the compressor 1 decreases (or a pressure difference between the refrigerants on the suction side and the discharge side of the compressor 1 decreases), and surging is avoided. In this way, the surging control device 40 monitors the occurrence status of surging in the compressor 1, and when surging occurs, controls to avoid or suppress surging through the opening degree control of the circulation flow regulation valve V1.

(Configuration of Control Device)

Next, the surging control of the first embodiment will be described in detail with reference to FIG. 2.

Figure 2:
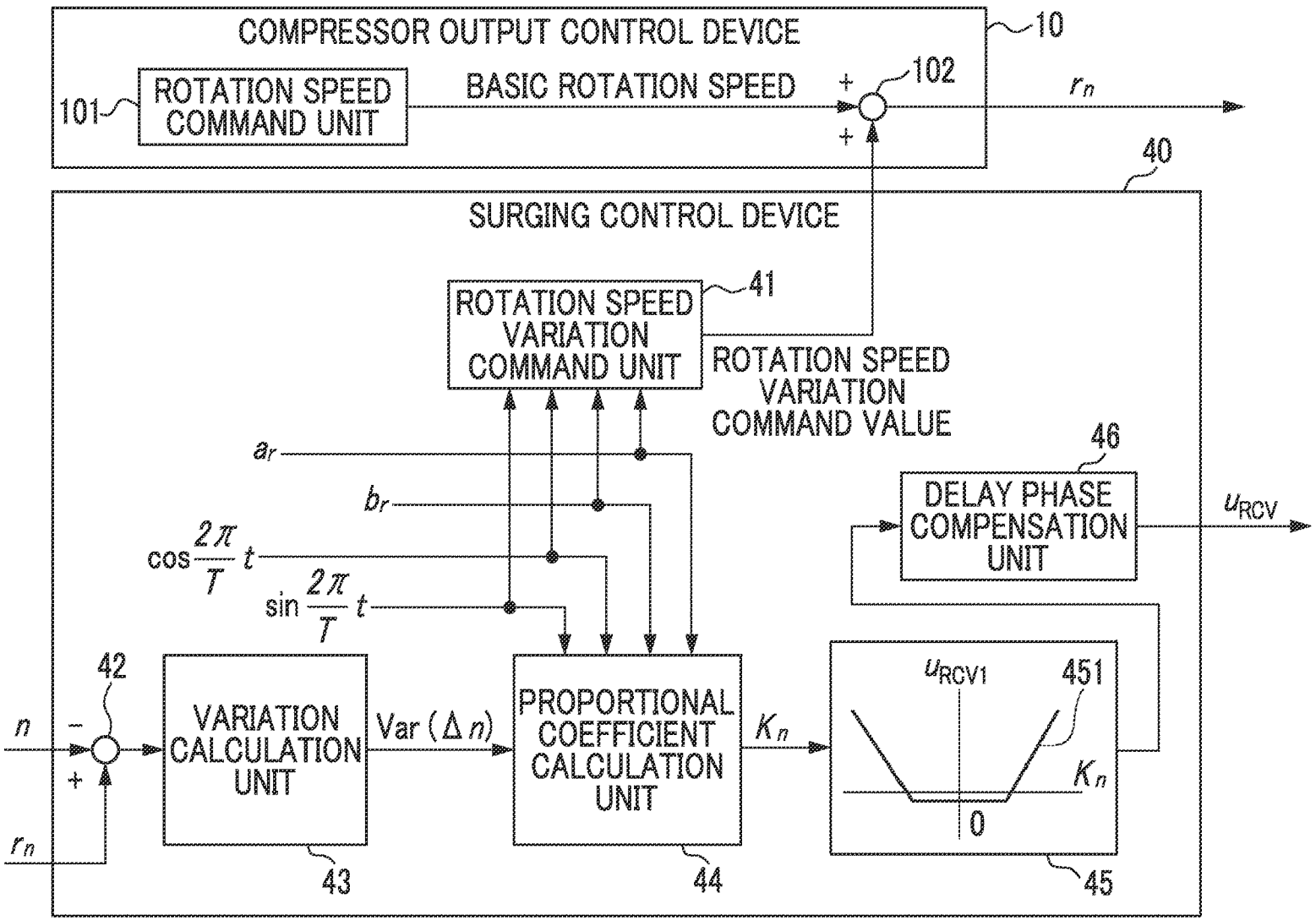
FIG. 2 is a diagram showing an example of a control device according to the first embodiment.

FIG. 2 is a diagram showing an example of the control device (the compressor output control device 10 and the surging control device 40) according to the first embodiment.

The compressor output control device 10 includes a rotation speed command unit 101 and an addition unit 102.

The rotation speed command unit 101 calculates the rotation speed (referred to as a basic rotation speed) of the compressor 1 according to the load of the chilling system 100 and outputs the rotation speed to the addition unit 102.

The addition unit 102 acquires a rotation speed variation command value from the surging control device 40 and adds the rotation speed variation command value to the basic rotation speed. The addition unit 102 outputs the added value to the variable speed drive device 20 as the rotation speed command value $r_n$. As will be described next, the rotation speed variation command value $r_n$ is a value that is changed periodically. For example, when the basic rotation speed is 10000 (rpm), the magnitude of the variation amount is substantially 100 to 200 (rpm). The rotation speed command value $r_n$, which is output by the addition unit 102, is, for example, a value that is periodically changed within a range of 9800 to 10200 (rpm).

The surging control device 40 includes a rotation speed variation command unit 41, a subtraction unit 42, a variation calculation unit 43, a proportional coefficient calculation unit 44, an opening degree command value calculation unit 45, and a delay phase compensation unit 46.

The rotation speed variation command unit 41 calculates the above rotation speed variation command value by using, for example, following Equation (1) and outputs the rotation speed variation command value to the compressor output control device 10.

$$a_r\cos\left(\frac{2\pi}{T}t\right)+b_r\sin\left(\frac{2\pi}{T}t\right) \tag{1}$$

Here, $a_r$ and $b_r$ are any constants, t is time, and T is any cycle. The length of T is, for example, substantially 10 seconds. The rotation speed variation command value may include a harmonic that is an integral multiple of the cycle T, for example, as in following Equation (LA).

$$a_r\cos\left(\frac{2\pi}{T}t\right)+b_r\sin\left(\frac{2\pi}{T}t\right)+\sum_{m=2}^{\infty}\left(a_{r,m}\cos\left(\frac{2\pi}{T}mt\right)+b_{r,m}\cos\left(\frac{2\pi}{T}mt\right)\right) \tag{1A}$$

It is desirable that the variation in the rotation speed command value has a short cycle. In a chiller or the like that uses the compressor 1, it takes substantially one minute for a difference in cooling capacity to appear after the rotation speed command of the compressor 1 is changed due to the influence of the heat capacitance of the device. Therefore, when a variation cycle of the rotation speed command value is sufficiently shorter than one minute, the variation in the rotation speed command value does not appear in the cooling capacity. Based on such a viewpoint, the cycle T of the rotation speed command value is set shorter than a response cycle of the equipment in which the compressor 1 is used (for example, 10 seconds).

The subtraction unit 42 acquires a parameter of the response with respect to the rotation speed command value $r_n$ (the rotation speed n of the compressor 1 in the case in FIG. 2) and the rotation speed command value $r_n$, and calculates a difference therebetween. The subtraction unit 42 outputs the calculated difference to the variation calculation unit 43.

The variation calculation unit 43 calculates a deviation between the rotation speed n of the compressor 1 and the rotation speed command value $r_n$. When the operation of the compressor 1 is in a settling state, the rotation speed n of the compressor 1 coincides with the rotation speed command value $r_n$ of the compressor 1. However, when surging occurs, the rotation speed of the compressor is changed and has a deviation $\Delta n = r_n - n$ with respect to the command value. The magnitude of the deviation $\Delta n$ can be measured, for example, by using variance. The variation calculation unit 43 calculates the variance by using following Equation (2). E indicates an average. The variance is an example, and the deviation $\Delta n$ may be directly used as the variation, or the amplitude of a specific frequency bandwidth included in $\Delta n$ may be used by means such as a Fourier transform. Alternatively, a deviation with the average value of the rotation speed n may be used. This is the same in other embodiments.

$$\mathrm{Var}(\Delta n) = E((\Delta n - E(\Delta n))^2) \tag{2}$$

The proportional coefficient calculation unit 44 calculates a proportional coefficient of the response (the rotation speed n of the compressor 1) with respect to the rotation speed command value $r_n$ based on the deviation (the variance) calculated by the variation calculation unit 43. First, the proportional coefficient calculation unit 44 evaluates the component of the cycle T from the variation in the rotation speed command value $r_n$ of Var ($\Delta n$) by using following Equations (3A) and (3B).

In Equations (3A) and (3B), a movement average value of a function to be integrated is calculated for a time interval T. In the movement average calculation, a load coefficients are all 1 with respect to time in Equations (3A) and (3B). However, for example, the movement average value may be calculated by adding a load coefficient with respect to time by using a window function such as a Hanning window or a Hamming window.

$$a_n = \frac{2}{T}\int_{t-T}^{t} \mathrm{Var}(\Delta n)\cos\left(\frac{2\pi}{T}t\right)dt \tag{3A}$$

$$b_n = \frac{2}{T}\int_{t-T}^{t} \mathrm{Var}(\Delta n)\sin\left(\frac{2\pi}{T}t\right)dt \tag{3B}$$

The proportional coefficient calculation unit 44 derives following Equation (4) from Equations (3A) and (3B), and calculates a proportional coefficient $K_n$ by using Equation (4). When the cycle T is set sufficiently long with respect to a time scale in which surging grows or disappears, following Equation (4) represents the proportional coefficient $K_n$ of the variation in the rotation speed caused by changing the rotation speed command value at the cycle T. Equations (3A) and (3B) represent, as a basic form, to evaluate a variation component having the same cycle as the rotation speed variation cycle T, but the present disclosure is not limited thereto. For example, as a modification example, the variation component may be evaluated such that the cycle is T/2, T/3, T/4, and so on. In Equation (3A), cos ((2Π/T)t) is used as a coefficient, and in Equation (3B), sin ((2Π/T)t) is used as a coefficient in Var($\Delta$n), and it is essential that the coefficient values repeat at the cycle T, but since it is essential that the values of the coefficients repeat with a cycle T, thereby coefficients may be changed to sgn(cos ((2Π/T)t)) or sgn(sin((2Π/T)t)), for example. Here, sgn( ) is a function in which a value of sgn is 1 when an input value is positive, the value of sgn is −1 when the input value is negative, and a value of sgn is 0 when the input value is 0.

$$\kappa_n = \frac{a_r a_n + b_r b_n}{a_r^2 + b_r^2} \tag{4}$$

The opening degree command value calculation unit 45 determines the occurrence status of surging based on the proportional coefficient $K_n$ and calculates an opening degree command value $u_{RCV1}$ of the circulation flow regulation valve V1 according to the occurrence status of surging. For example, the opening degree command value calculation unit 45 includes a function or the like that converts the proportional coefficient $K_n$ into the opening degree command value $u_{RCV1}$ of the circulation flow regulation valve V1, and calculates the opening degree command value $u_{RCV1}$ of the circulation flow regulation valve V1 based on the function or the like and the proportional coefficient $K_n$. An example of a polygonal line function 451, which is included in the opening degree command value calculation unit 45, is shown in FIG. 2. The lower the rotation speed command, the more severe the degree of surging. Therefore, when an operation condition approaches the surge line, the proportional coefficient $K_n$ related to the variation in the rotation speed becomes a large value on the negative side. Therefore, in principle, it is sufficient to open the circulation flow regulation valve V1 when the proportional coefficient $K_n$ becomes a large value on the negative side. However, even when the value is positive in practice, the circulation flow regulation valve V1 should be opened when the proportional coefficient $K_n$ becomes large. Therefore, as shown in the polygonal line function 451 in FIG. 2, regardless of whether the proportional coefficient $K_n$ is positive or negative, the polygonal line has a shape such that, as the value increases, the circulation flow regulation valve opening degree command value $u_{RCV1}$ is changed to open the circulation flow regulation valve V1.

When the magnitude of the proportional coefficient $K_n$ exceeds the acceptance limit of surging, the delay phase compensation unit 46 determines the opening degree of the circulation flow regulation valve V1 by using the delay phase compensation. The delay phase compensation unit 46 acquires the circulation flow regulation valve opening degree command value $u_{RCV1}$, performs integral control, and calculates the opening degree command value $u_{RCV}$ of the circulation flow regulation valve V1. The delay phase compensation unit 46 outputs the opening degree command value $u_{RCV}$ to the circulation flow regulation valve V1. As a result, the low frequency component of the opening degree command value $u_{RCV1}$ is amplified, and the opening degree command value $u_{RCV}$ is output to the circulation flow regulation valve V1.

(Operation of Control Device)

Next, with reference to FIGS. 2 and 3, control for detection of surging and handling of surging will be described.

Figure 3:
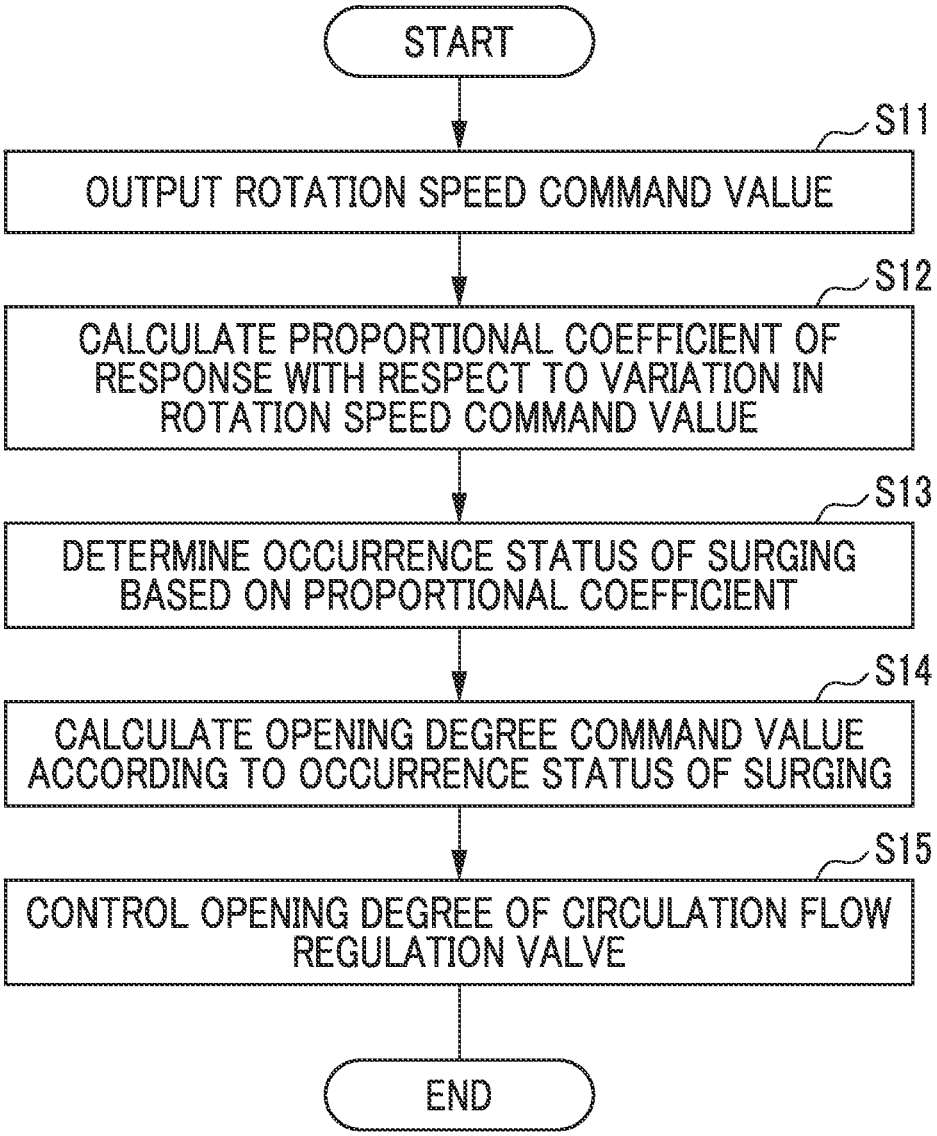
FIG. 3 is a diagram showing an example of an operation of the control device according to the first embodiment.

FIG. 3 is a diagram showing an example of an operation of the control device according to the first embodiment.

The compressor output control device 10 and the surging control device 40 repeatedly and continuously execute the following processes at predetermined control cycles during the operation of the compressor 1.

First, the compressor output control device 10 outputs the rotation speed command value to the variable speed drive device 20 (step S11). The rotation speed command unit 101 outputs the basic rotation speed. The rotation speed variation command unit 41 calculates the rotation speed variation command value by using Equation (1). The addition unit 102 adds the basic rotation speed and the rotation speed variation command value, and outputs the rotation speed command value to the variable speed drive device 20.

Next, the surging control device 40 calculates the proportional coefficient of the response with respect to the variation in the rotation speed command value (step S12).

First, the variation calculation unit 43 calculates the deviation between the rotation speed command value and the response by using Equation (2). Next, the proportional coefficient calculation unit 44 derives Equation (4) by using Equations (3A) and (3B), and calculates the proportional coefficient $K_n$ by using Equation (4). The proportional coefficient calculation unit 44 outputs the proportional coefficient $K_n$ to the opening degree command value calculation unit 45.

Next, the surging control device 40 evaluates the occurrence status of surging based on the proportional coefficient $K_n$ (step S13). For example, the opening degree command value calculation unit 45 determines that surging has not occurred when an absolute value of the proportional coefficient $K_n$ is less than a threshold value and determines that surging has occurred when the absolute value is equal to or greater than the threshold value.

Next, the surging control device 40 calculates the opening degree command value $u_{RCV}$ of the circulation flow regulation valve V1 according to the occurrence status of surging (step S14). For example, when surging has not occurred, the opening degree command value calculation unit 45 calculates a value of 0 or less as the opening degree command value $u_{RCV1}$. When surging has occurred, the opening degree command value calculation unit 45 calculates the opening degree command value $u_{RCV1}$ according to the magnitude of surging (the magnitude of the proportional coefficient). For example, the opening degree command value calculation unit 45 calculates a larger opening degree command value $u_{RCV1}$ as the degree of surging increases.

In the example of the configuration in FIG. 2, the opening degree command value calculation unit 45 simultaneously performs the processes of steps S13 and S14 based on the polygonal line function 451.

Next, the surging control device 40 controls the opening degree of the circulation flow regulation valve V1 (step S15). For example, the delay phase compensation unit 46 outputs the opening degree command value $u_{RCV}$, in which the delay phase compensation is performed on the opening degree command value $u_{RCV1}$, to the circulation flow regulation valve V1.

As described above, according to the present embodiment, the compressor output control device 10 outputs the rotation speed command value obtained with periodic variation with respect to the compressor 1. The surging control device 40 acquires the response with respect to the variation in the rotation speed command value, and calculates a relationship (the proportional coefficient $K_n$) between both the variation in the rotation speed command value and the response. The response of the compressor 1 such as the pressure or the rotation speed is also changed due to factors other than surging. Therefore, in order to accurately detect the response due to surging, in the present embodiment, change is made for the rotation speed command value, which has a particularly strong effect on surging, the magnitude of the response is evaluated (Equation (4)) by extracting the component of the cycle from the response of the compressor 1 with respect to the variation in the rotation speed command value (Equation (3A), equation (3B)), and the occurrence of surging is determined based on the magnitude of the response. In this method, the occurrence of surging can be detected with high accuracy by excluding the influence of the dimensions of the pipes P1, P3, or the like connected to the compressor 1, the temperature or composition of the refrigerant, the circulation flow regulation valve V1 of the circulation flow pipe P4, or the like. By appropriately setting the threshold value for determining the occurrence of surging, the occurrence of surging can be detected quickly.

In the above-described embodiment, the rotation speed n of the compressor 1 has been described as an example as the response of the compressor 1, but other parameters may be used as the response with respect to the variation in the rotation speed command value. For example, it is also possible to perform surging control by using a variation in a current value, a variation in the pressure of the refrigerant discharged by the compressor 1, a variation in the pressure ratio of the refrigerant before and after the compressor 1, a variation in the flow rate of the refrigerant, vibration of the main body of the compressor 1, vibration of the shaft and the bearing of the compressor 1, the rotation speed of the electric motor 30, the current consumption or the power consumption of the electric motor 30, vibration, vibration of the shaft and the bearing of the main body of the electric motor 30, and the periphery noise. In order to simplify the notation, a measured value used for surging control is represented as $y_i \ldots$, (i=1, 2, 3 . . . ). For example, $y_1$ may be the rotation speed of the compressor 1, $y_2$ may be the discharge pressure, $y_3$ may be the pressure ratio, and $y_4$ may be the flow rate. At this time, the variation calculation unit 43 calculates the variation (the variance) by using following Equation (5).

$$\mathrm{Var}(y_i)=E((\Delta y_i-E(\Delta y_i))^2), i=1,2,3 \tag{5}$$

The proportional coefficient calculation unit 44 extracts the component of the cycle T of the variation by using following Equations (6A) and (6B).

$$a_{y_i} = \frac{2}{T}\int_{t-T}^{t} \mathrm{Var}(y_i)\cos\left(\frac{2\pi}{T}t\right)dt \quad i = 1, 2, 3, \ldots \tag{6A}$$

$$b_{y_i} = \frac{2}{T}\int_{t-T}^{t} \mathrm{Var}(y_i)\sin\left(\frac{2\pi}{T}t\right)dt \quad i = 1, 2, 3, \ldots \tag{6B}$$

The proportional coefficient can be calculated with following Equation (7) by using above Equations (6A) and (6B). The proportional coefficient calculation unit 44 calculates $K_{yi}$ in Equation. (7) and executes detection and avoidance control of surging based on $K_{yi}$ $$\kappa_{y_i} = \frac{a_r a_{y_i} + b_r b_{y_i}}{a_r^2 + b_r^2} \quad i = 1, 2, 3, \ldots \tag{7}$$

According to the present embodiment, the compressor can be operated in a lightly surging state while avoiding surging in the compressor. As a result, the operating efficiency of the compressor is improved, and power such as electric power can be saved.

Second Embodiment (Configuration of Control Device)

Hereinafter, surging control according to a second embodiment of the present disclosure will be described with reference to FIG. 4.

Figure 4:
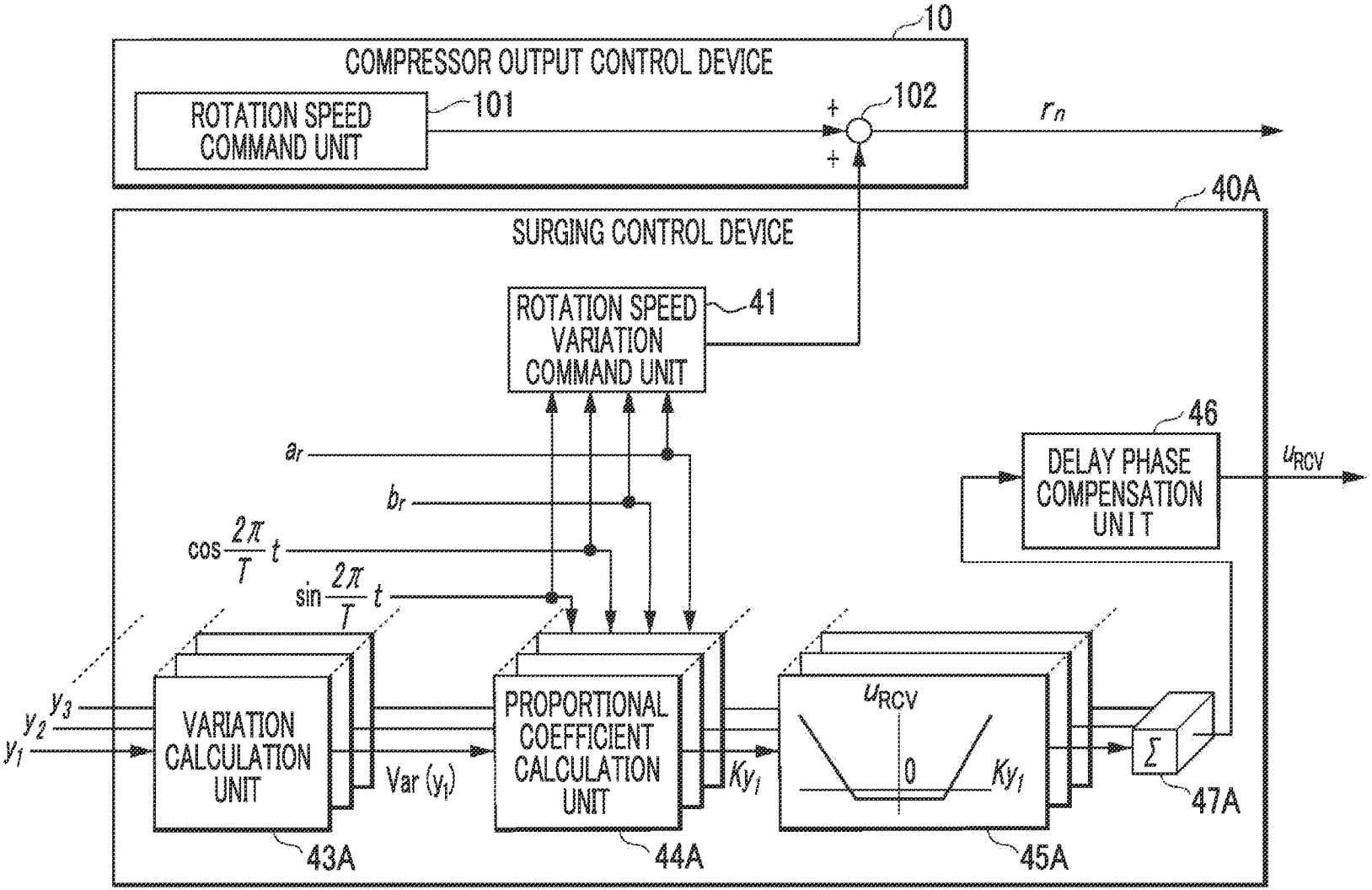
FIG. 4 is a diagram showing an example of a control device according to a second embodiment.

FIG. 4 is a diagram showing an example of a control device according to the second embodiment.

Among the configurations according to the second embodiment of the present disclosure, the same reference numerals are given to the same functional units as those constituting the compressor output control device 10 and the surging control device 40 according to the first embodiment of the present disclosure, and description thereof will be omitted. A surging control device 40A according to the second embodiment includes a rotation speed variation command unit 41, a variation calculation unit 43A, a proportional coefficient calculation unit 44A, an opening degree command value calculation unit 45A, a delay phase compensation unit 46, and a weighted sum calculation unit 47A.

The variation calculation unit 43A acquires a plurality of parameters $y_i$ (i=1, 2, 3 . . . ) and calculates a variation for each of the parameters by using above Equation (5).

The proportional coefficient calculation unit 44A calculates a proportional coefficient $K_{yi}$ for each of the parameters by using above Equation (7).

The opening degree command value calculation unit 45A calculates an opening degree command value $u_{RCV1i}$ for each of the proportional coefficients $K_{yi}$ of each parameter calculated by the proportional coefficient calculation unit 44A.

The weighted sum calculation unit 47A calculates a weighted sum for the opening degree command value $u_{RCV1i}$ of each parameter calculated by the opening degree command value calculation unit 45A.

The delay phase compensation unit 46 calculates an opening degree command value $u_{RCV}$ in which the delay phase compensation is performed for the weighted sum of the opening degree command value $u_{RCV1i}$ calculated by the weighted sum calculation unit 47A, and outputs the opening degree command value $u_{RCV}$ to the circulation flow regulation valve V1.

The operation is the same as that of the first embodiment except that a plurality of parameters are monitored and a weighted sum of the opening degree command values $u_{RCVi}$ for each parameter is used.

That is, first, the compressor output control device 10 outputs the rotation speed command value having a variation to the variable speed drive device 20 (step S11). Next, the surging control device 40 calculates a proportional coefficient $K_{ni}$ of the response with respect to the variation in the rotation speed command value for each parameter (step S12). Next, the surging control device 40 evaluates the occurrence status of surging for each proportional coefficient $K_{ni}$ (step S13), and calculates the opening degree command value $u_{RCV1}$ of the circulation flow regulation valve V1 according to the occurrence status of surging (step S14). Next, the weighted sum calculation unit 47A calculates a weighted sum of the opening degree command value $u_{RCV1i}$ (i=1, 2, 3 . . . ). Next, the surging control device 40 controls the opening degree of the circulation flow regulation valve V1 (step S15).

According to the second embodiment, since the occurrence status of surging is determined based on the plurality of parameters, in addition to the effect of the first embodiment, the effect of further improving the reliability can be obtained.

Third Embodiment (Configuration)

Hereinafter, surging control according to a third embodiment of the present disclosure will be described with reference to FIGS. 5 to 6.

Figure 5:
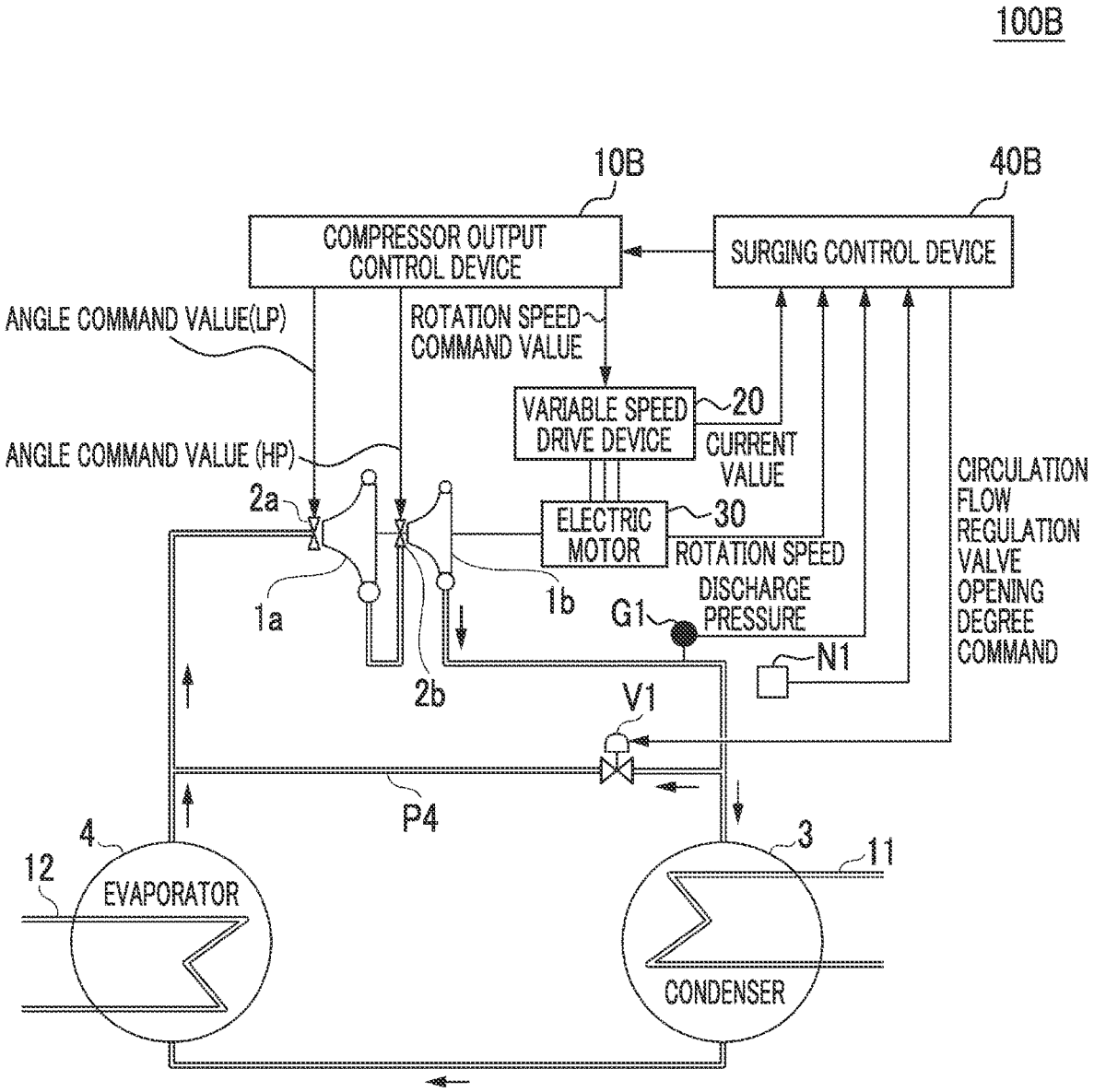
FIG. 5 is a diagram showing an example of a chilling system according to a third embodiment.

FIG. 5 is a diagram showing an example of a chilling system according to a third embodiment.

As shown in the drawing, a chilling system 100B includes a low-pressure side compressor (LP) 1*a* and a high-pressure side compressor (HP) 1*b* connected in series. An inlet guide vane (LP) 2*a* is provided on a suction side of the compressor (LP) 1*a*, and an inlet guide vane (HP) 2*b* is provided on a suction side of the compressor (HP) 1*b*. A compressor output control device 10B outputs individual angle command values to the inlet guide vane (LP) 2*a* and the inlet guide vane (HP) 2*b*. The compressor (LP) 1*a* and the compressor (HP) 1*b* are provided coaxially and are driven by a common rotation shaft. That is, the compressor (LP) 1*a* and the compressor (HP) 1*b* rotate at the same speed. The compressor output control device 10B outputs a rotation speed command value, which is sent to the compressor (LP) 1*a* and the compressor (HP) 1*b*, to the variable speed drive device 20, and the electric motor 30 rotationally drives a common rotation shaft of the compressor (LP) 1*a* and the compressor (HP) 1*b*. Other configurations of the chilling system 100B are the same as those described with reference to FIG. 1.

In the chilling system 100B in FIG. 5, when one compressor performs surging, the discharge pressure, which is measured by the pressure sensor G1, the flow rate of the refrigerant, or the like is changed. For example, the discharge pressure is changed when surging occurs in the compressor (LP) 1*a*, and the discharge pressure is also changed when surging occurs in the compressor (HP) 1*b*. As described above, in the case of a configuration including a plurality of compressors, when surging occurs in one compressor, the problem may persist no matter how far the other operation conditions are from the surge line. When the margin for the surge line can be controlled to be equal among the compressors, it is effective in avoiding surging when there are a plurality of compressors. In the case of a configuration including a plurality of compressors, there is a probability that an operation condition of one compressor reaches a surging region earlier than that of another compressor.

In the third embodiment, in order to avoid such a phenomenon, by changing the angle command value of the inlet guide vane and performing the angle control of the inlet guide vane for each compressor based on the response, the margin with respect to the surge line of each compressor is made to be uniform, and it is avoided that one compressor reaches the surge line extremely early compared to others and that the (shared) circulation flow regulation valve V1 is opened just for that compressor.

(Configuration of Control Device)

Next, the control devices (the compressor output control device 10B and the surging control device 40B) of the third embodiment will be described in detail with reference to FIG. 6.

Figure 6:
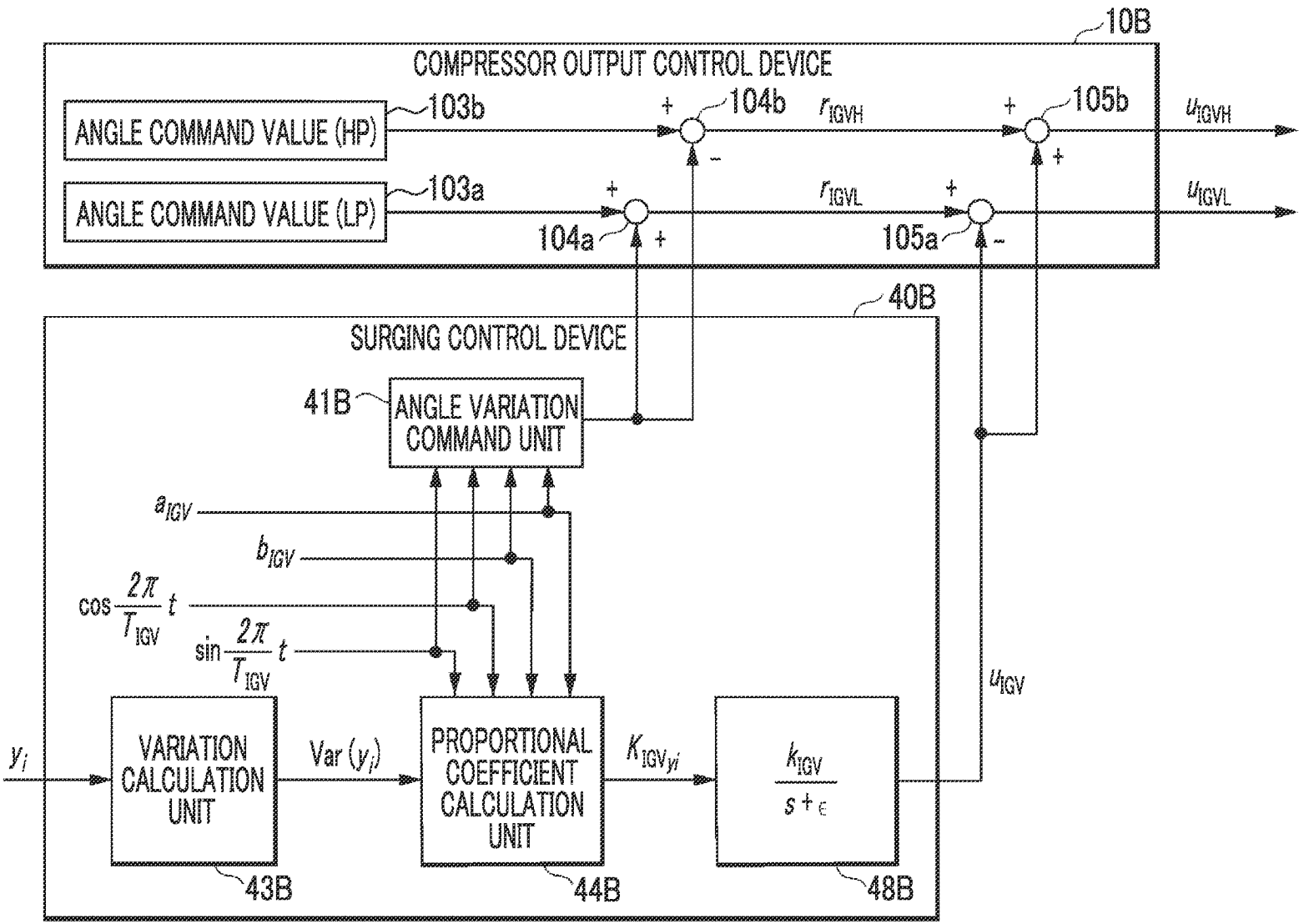
FIG. 6 is a diagram showing an example of a control device according to a third embodiment.

FIG. 6 is a diagram showing an example of the control device according to the third embodiment.

The compressor output control device 10 includes an angle command unit (LP) 103*a*, an angle command unit (HP) 103*b*, an addition unit 104*a*, a subtraction unit 104*b*, a subtraction unit 105*a*, and an addition unit 105*b*.

The angle command unit (LP) 103*a* calculates an angle command value $r_{IGVL}$ to the inlet guide vane (LP) 2*a*.

The angle command unit (HP) 103*b* calculates an angle command value $r_{IGVH}$ to the inlet guide vane (HP) 2*b*.

The addition unit 104*a* adds an angle variation command value output by the surging control device 40B to the angle command value, which is sent to the inlet guide vane (LP) 2*a* and calculates the angle command value $r_{IGVL}$ (Equation (8A)).

$$r_{IGVL} \leftarrow r_{IGVL} + a_{IGV}\cos\left(\frac{2\pi}{T_{IGV}}t\right) + b_{IGV}\sin\left(\frac{2\pi}{T_{IGV}}t\right) \tag{8A}$$

The subtraction unit 104*b* subtracts the angle variation command value output by the surging control device 40B from the angle command value, which is sent to the inlet guide vane (HP) 2*b*, and calculates the angle command value $r_{IGVH}$ (Equation (8B)).

$$r_{IGVH} \leftarrow r_{IGVH} - a_{IGV}\cos\left(\frac{2\pi}{T_{IGV}}t\right) - b_{IGV}\sin\left(\frac{2\pi}{T_{IGV}}t\right) \tag{8B}$$

The subtraction unit 105*a* subtracts a compensation amount $u_{IGV}$ output by the surging control device 40B from the angle command value $r_{IGVL}$ and calculates an angle command value $u_{IGVL}$ (Equation (9A)).

$$u_{IGVL}=r_{IGVL}-u_{IGV} \tag{9A}$$

The addition unit 105*b* adds the compensation amount $u_{IGV}$ output by the surging control device 40B to the angle command value $r_{IGVH}$ and calculates an angle command value $u_{IGVH}$ (Equation (9B)).

$$u_{IGVH}=r_{IGVH}u_{IGV} \tag{9B}$$

In the first embodiment and the second embodiment, the rotation speed of the compressor 1 is changed to detect surging, whereas in the third embodiment, the angles of the inlet guide vanes 2*a* and 2*b* are changed. When the rotation speed of the compressor is changed, the operation condition is changed in the longitudinal direction of the graph in FIG. 10. On the other hand, when the angle of the inlet guide vane is changed, the operation condition is mainly changed in the lateral direction of the graph. In the case of the chilling system 100B, the rotation shafts of the compressor (LP) and the compressor (HP) are common, and the respective operation conditions cannot be independently changed by controlling the rotation speed. Therefore, in the present embodiment, the operation conditions of the compressors 1*a* and 1*b* are changed by changing the angle of the inlet guide vane (LP) and the angle of the inlet guide vane (HP), respectively. The angle command value $r_{IGVL}$, and the angle command value $r_{IGVH}$ are configured such that the output of the compressor (the flow rate when the work or the pressure ratio is the same) increases as the values increase.

The surging control device 40B includes an angle variation command unit 41B, a variation calculation unit 43B, a proportional coefficient calculation unit 44B, and a compensation amount calculation unit 48B.

The angle variation command unit 41B calculates the above angle variation command value by using, for example, following Equation (10), and outputs the angle variation command value to the compressor output control device 10B.

$$a_{IGV}\cos\left(\frac{2\pi}{T_{IGV}}t\right) + b_{IGV}\sin\left(\frac{2\pi}{T_{IGV}}t\right) \tag{10}$$

Here, $a_{IGV}$ and $b_{IGV}$ are any constants, t is time, and $T_{IGV}$ is any cycle. The angle variation command value may include, for example, a harmonic that is an integral multiple of the cycle $T_{IGV}$.

As with the rotation speed command value, it is desirable that the variation in the angle variation command value has a short cycle. When a variation cycle of the angle variation command value is sufficiently shorter than one minute, the variation in the angle command value does not appear in the cooling capacity.

The variation calculation unit 43B calculates a variation in the parameter $y_i$. Examples of the parameter $y_i$ include a rotation speed of the compressor 1, a current value, discharge pressure of the compressor 1, a pressure ratio before and after the compressor 1, a flow rate of the refrigerant, vibration of the main body of the compressor 1, vibration of a shaft and a bearing of the compressor 1, a rotation speed of the electric motor 30, current consumption or power consumption of the electric motor 30, vibration, vibration of a shaft and a bearing of the main body of the electric motor 30, and the like. The variation calculation unit 43B calculates the variation (the variance) by using above Equation (5).

The proportional coefficient calculation unit 44B calculates a proportional coefficient of the response with respect to the variation in the angle command value based on the variation (the variance) calculated by the variation calculation unit 43B. First, the proportional coefficient calculation unit 44B evaluates the component of the cycle T by using following Equations (11A) and (11B).

$$a_{IGV_{y_i}} = \frac{2}{T_{IGV}}\int_{t-T_{IGV}}^{t} \mathrm{Var}(y_i)\cos\left(\frac{2\pi}{T_{IGV}}t\right)dt \quad i = 1, 2, 3, \ldots \tag{11A}$$

$$b_{IGV_{y_i}} = \frac{2}{T_{IGV}}\int_{t-T_{IGV}}^{t} \mathrm{Var}(y_i)\sin\left(\frac{2\pi}{T_{IGV}}t\right)dt \quad i = 1, 2, 3, \ldots \tag{11B}$$

The proportional coefficient calculation unit 44B derives following Equation (12) from Equations (11A) and (11B), and calculates a proportional coefficient $K_{IGVyi}$ by using Equation (12).

$$\kappa_{IGV_{y_i}} = \frac{a_{IGV}a_{IGV_{y_i}} + b_{IGV}b_{IGV_{y_i}}}{a_{IGV}^2 + b_{IGV}^2} \quad i = 1, 2, 3, \ldots \tag{12}$$

The compensation amount calculation unit 48B calculates the compensation amount $u_{IGV}$ of the angle command value with respect to the inlet guide vane (LP) 2*a* and the inlet guide vane (HP) 2*b* according to a degree of approach to the surging line of the operation condition of the compressor (LP) 1*a* and the compressor (HP) 1*b*. When a value of the proportional coefficient $K_{IGVyi}$ is positive, the surging in the compressor (LP) 1*a* needs to be handled. When the value of the proportional coefficient $K_{IGVyi}$ is negative, the surging in the compressor (HP) 1*b* needs to be handled. Therefore, when the value of the proportional coefficient $K_{IGVyi}$ is positive, the compensation amount calculation unit 48B performs adjustment by using, for example, a compensator having an integral characteristic such as following Equation (13) such that the work of the compressor (LP) 1*a* is reduced and the work of the compressor (HP) 1*b* is increased. $K_{IGV}$ is a proportional gain, and is a constant that determines a bandwidth of incomplete integration.

$$u_{IGV} = \frac{k_{IGV}}{s + \epsilon} \tag{13}$$

(Operation of Control Device)

Next, a process of equally controlling the margin to the surging line between the compressors will be described with reference to FIGS. 6 and 7.

Figure 7:
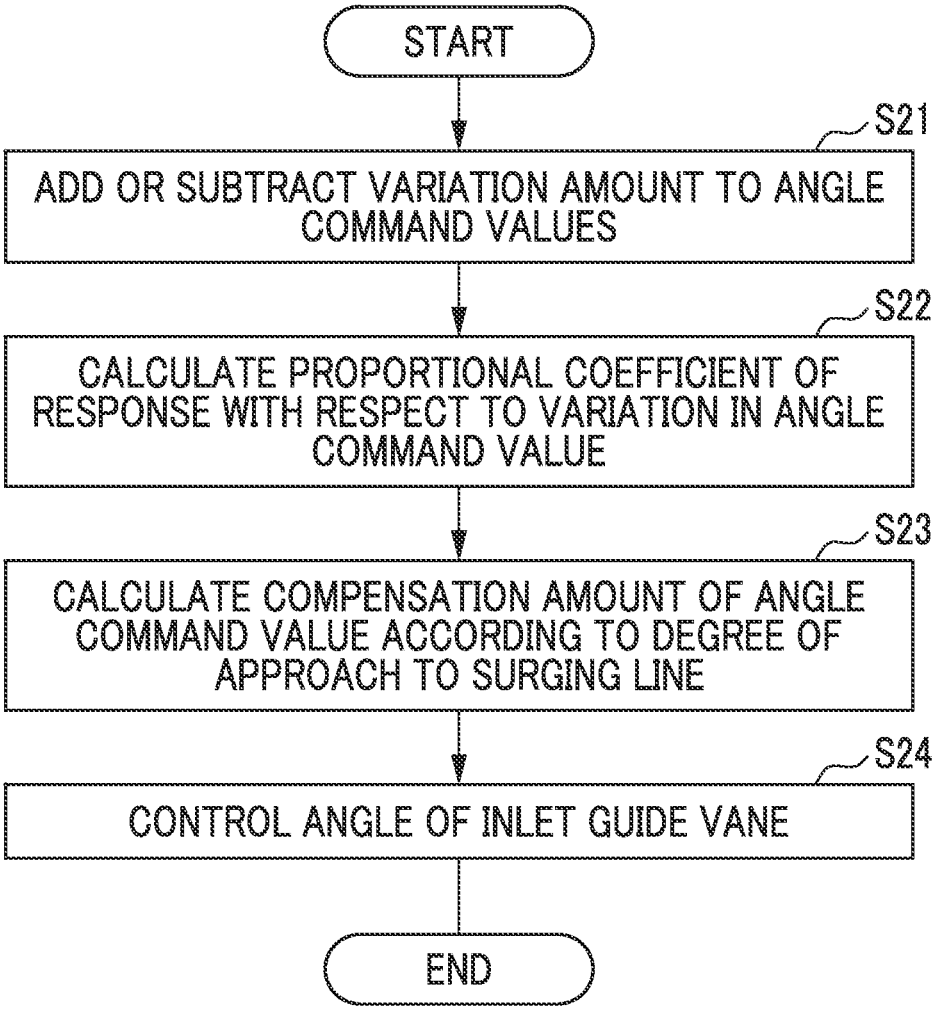
FIG. 7 is a diagram showing an example of an operation of the control device according to the third embodiment.

FIG. 7 is a diagram showing an example of an operation of the control device according to the third embodiment.

The compressor output control device 10B and the surging control device 40B repeatedly and continuously execute the following processes at predetermined control cycles during the operation of the compressor 1.

The compressor output control device 10 adds or subtracts the variation amount to the angle command values with respect to the inlet guide vane (LP) 2*a* and the inlet guide vane (HP) 2*b* (step S21). First, the angle command unit (LP) 103*a* calculates the angle command value $u_{IGVL}$, which is sent to the inlet guide vane (LP) 2*a*, and the angle command unit (HP) 103*b* calculates the angle command value $u_{IGVH}$, which is sent to the inlet guide vane (HP) 2*b*. Next, the addition unit 104*a* calculates the angle command value $r_{IGVL}$, by adding a variation amount, which is calculated by the angle variation command unit 41B, to the angle command value $r_{IGVL}$, which is calculated by the angle command unit (LP) 103*a*. The subtraction unit 104*b* calculates the angle command value $r_{IGVH}$ by subtracting the variation amount, which is calculated by the angle variation command unit 41B, from the angle command value $r_{IGVH}$, which is calculated by the angle command unit (HP) 103*b*.

Next, the surging control device 40 calculates the proportional coefficient of the response with respect to the variation in the angle command value output to the inlet guide vane (LP) 2*a* and the inlet guide vane (HP) 2*b* (step S22). The variation calculation unit 43B calculates the variation in the response parameter by using Equation (5). Next, the proportional coefficient calculation unit 44B derives Equation (12) by using Equations (11A) and (11B) and calculates the proportional coefficient $K_{IGVyi}$ by using Equation (12). The proportional coefficient calculation unit 44B outputs the proportional coefficient $K_{IGVyi}$ to the compensation amount calculation unit 48B.

Next, the compensation amount calculation unit 48B calculates the compensation amount of the angle command value according to the degree of approach to the surging line (step S23). When the proportional coefficient $K_{IGVyi}$ is positive, it indicates that the work of the compressor (LP) 1*a* is correspondingly large and there is a high possibility that surging may occur when a load is applied, thereby the compensation amount calculation unit 48B calculates the compensation amount $u_{IGV}$ for reducing the work of the compressor (LP) 1*a* (the angle of the inlet guide vane (LP) 2*a* is reduced) and increasing the work of the compressor (HP) 1*b* (the angle of the inlet guide vane (HP) 2*b* is increased). When the proportional coefficient $K_{IGVyi}$ is negative, the compensation amount calculation unit 48B calculates the compensation amount $u_{IGV}$ for increasing the work of the compressor (LP) 1*a* (the angle of the inlet guide vane (LP) 2*a* is increased) and reducing the work of the compressor (HP) 1*b* (the angle of the inlet guide vane (HP) 2*b* is reduced). The subtraction unit 105*a* subtracts the compensation amount $u_{IGV}$ from the angle command value $r_{IGVL}$ calculated in step S21 (Equation (9A)) and calculates the angle command value $u_{IGVL}$. In contrast to this, the addition unit 105*b* adds the compensation amount $u_{IGV}$ to the angle command value $r_{IGVH}$ (Equation (9B)) and calculates the angle command value $u_{IGVH}$. The compressor output control device 10B outputs the angle command value $u_{IGVL}$ to the inlet guide vane (LP) 2*a*. The compressor output control device 10B outputs the angle command value $u_{IGVH}$ to the inlet guide vane (HP) 2*b*. In this way, by correcting the angle command value of the inlet guide vane (LP) 2*a* and the angle command value to the inlet guide vane (HP) 2*b* to swing in opposite directions, uniformization of the work and equalization of the margin to the surging line is achieved. In the present embodiment, it is described that reducing the work of the compressor whose proximity degree is close to the surging line and increasing the work of the compressor whose proximity degree is far from the surging line are performed at the same time. Both processes do not necessarily have to be performed, for example, only the process of increasing the work of the compressor whose proximity degree to the surging line is far may be performed.

According to the present embodiment, the margin with respect to the surge line under the operation condition of each of the compressors 1*a* and 1*b* is made to equal between the compressors, thereby it is possible to avoid situations in which surging occurs in only one compressor. As a result, the probability of avoiding surging can be improved in the entire chilling system 100B.

In the third embodiment, as in the second embodiment, the compensation amount $u_{IGVyi}$ may be calculated for each of the plurality of parameters, and the weighted sum of the compensation amounts $u_{IGVyi}$ may be calculated to calculate the final compensation amount $u_{IGV}$.

The third embodiment can be combined with the first embodiment or the second embodiment. That is, the opening degree control of the circulation flow regulation valve V1 can be controlled while changing the rotation speed command value, which is to the compressors 1*a* and 1*b*, and in parallel, angle control with respect to the inlet guide vane (LP) 2*a* and the inlet guide vane (HP) 2*b* of the third embodiment can be performed.

Fourth Embodiment

Hereinafter, surging control according to a fourth embodiment of the present disclosure will be described with reference to FIGS. 8 and 9.

The first embodiment to the third embodiment relate to control for detecting the occurrence of surging at an early stage and avoiding surging. The fourth embodiment is for minimizing the opening degree when the operation condition of the compressor has already exceeded the surge line and the operation is being made with the circulation flow regulation valve V1 open. For that purpose, in the fourth embodiment, the opening degree of the circulation flow control valve, which is a surging avoidance means and is a dominant factor in surging control, is changed and the proportional coefficient of the response of the compressor 1 with respect to that variation is used.

Even when the controls in the first embodiment to the third embodiment are executed, for example, a situation may occur in which the compressor 1 must be operated under the operation condition in the surging region, depending on the requirements of the chilling system 100 and the load conditions. The control in the fourth embodiment described below is effective in such a situation.

(Configuration of Control Device)

Figure 8:
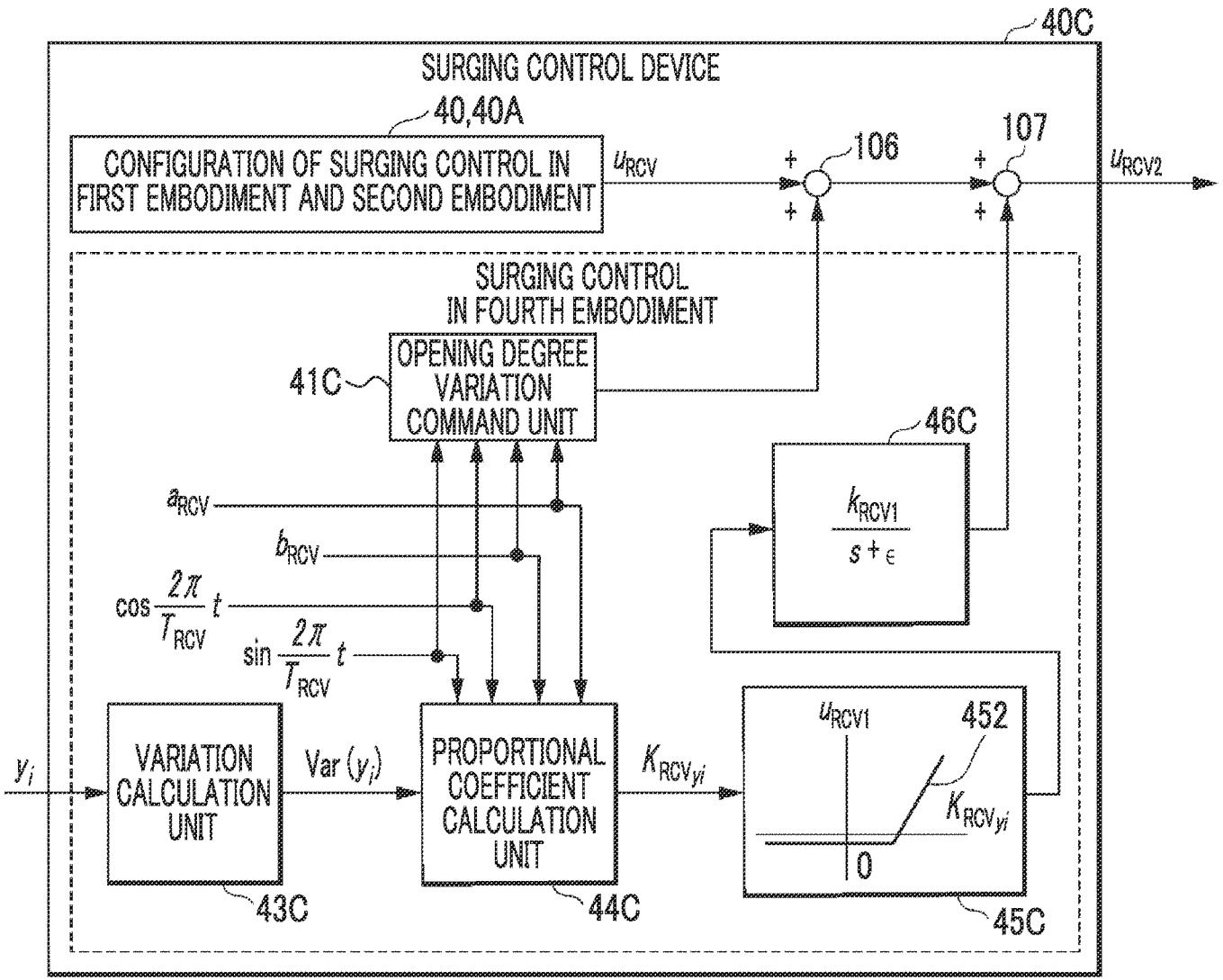
FIG. 8 is a diagram showing an example of a control device according to a fourth embodiment.

FIG. 8 is a diagram showing an example of the control device (a surging control device 40C) according to a fourth embodiment.

The compressor output control device 10 has the same configuration as that of the first embodiment or the second embodiment. In addition to the configuration of the first embodiment or the second embodiment, the surging control device 40C includes an opening degree variation command unit 41C, a variation calculation unit 43C, a proportional coefficient calculation unit 44C, an opening degree command value calculation unit 45C, a delay phase compensation unit 46C, an addition unit 106, and an addition unit 107.

The opening degree variation command unit 41C calculates the opening degree variation command value of the circulation flow regulation valve V1 by using, for example, following Equation (14).

$$a_{RCV}\cos\left(\frac{2\pi}{T_{RCV}}t\right)+b_{RCV}\sin\left(\frac{2\pi}{T_{RCV}}t\right) \tag{14}$$

Here, $a_{RCV}$ and $b_{RCV}$ are any constants, t is time, and $T_{RCV}$ is any cycle. The opening degree variation command value may include, for example, a harmonic that is an integral multiple of the cycle $T_{Rcv}$.

The addition unit 106 adds the opening degree variation command value, which is calculated by the opening degree variation command unit 41C, to the opening degree command value $u_{RCV}$ of the circulation flow regulation valve V1 calculated by the process in the first embodiment or the second embodiment.

The variation calculation unit 43C calculates the variation in the parameter $y_i$. The variation calculation unit 43C calculates the variation (the variance) by using above Equation (5).

The proportional coefficient calculation unit 44C calculates a proportional coefficient of the response with respect to the variation in the opening degree command value based on the variation (the variance) calculated by the variation calculation unit 43C. First, the proportional coefficient calculation unit 44C evaluates the component of the cycle $T_{RCV}$ by using following Equations (15A) and (15B).

$$a_{RCV_{y_i}}=\frac{2}{T_{RCV}}\int_{t-T_{RCV}}^{t}\mathrm{Var}(y_i)\cos\left(\frac{2\pi}{T_{RCV}}t\right)dt \quad i=1,2,3,\ldots \tag{15A}$$

$$b_{RCV_{y_i}}=\frac{2}{T_{RCV}}\int_{t-T_{RCV}}^{t}\mathrm{Var}(y_i)\sin\left(\frac{2\pi}{T_{RCV}}t\right)dt \quad i=1,2,3,\ldots \tag{15B}$$

The proportional coefficient calculation unit 44C derives following Equation (16) from Equations (15A) and (15B), and calculates a proportional coefficient $KC_{RCVyi}$ by using Equation (16).

$$\kappa_{RCV_{yi}}=\frac{a_{RCV}a_{RCV_{y_i}}+b_{RCV}b_{RCV_{y_i}}}{a_{RCV}^2+b_{RCV}^2} \quad i=1,2,3,\ldots \tag{16}$$

The opening degree command value calculation unit 45C calculates the opening degree command value $u_{RCV1}$ of the circulation flow regulation valve V1 based on the proportional coefficient $K_{RCVyi}$. For example, the opening degree command value calculation unit 45C includes a function or the like that converts the proportional coefficient $K_n$ into the opening degree command value $u_{RCV1}$ of the circulation flow regulation valve V1, and calculates the opening degree command value $u_{RCV1}$ of the circulation flow regulation valve V1 based on the function or the like and the proportional coefficient $K_{RCVyi}$. An example of a polygonal line function 452, which is included in the opening degree command value calculation unit 45C, is shown in FIG. 8. The degree of surging becomes more severe as the opening degree command value of the circulation flow regulation valve V1 becomes smaller. As shown in the polygonal line function 452, the calculation is made for the circulation flow regulation valve opening degree command value $u_{RCV1}$, which is a value of 0 or less before the value of the proportional coefficient $K_{RCVyi}$ exceeds the threshold value and which is increased as the value of the proportional coefficient $K_{RCVyi}$ is increased when the value of the proportional coefficient $K_{RCVyi}$ exceeds the threshold value. As a result, the opening degree of the circulation flow regulation valve V1 is compensated to be the necessary minimum.

When the magnitude of the proportional coefficient $K_{RCVyi}$ exceeds the surging acceptance limit, the delay phase compensation unit 46C calculates the compensation amount $u_{RCV3}$ of the circulation flow regulation valve V1 by using the delay phase compensation, for example, by using following Equation (17), and outputs the compensation amount $u_{RCV3}$ to the addition unit 107. $k_{RCV}$ is a proportional gain, is a constant that determines the bandwidth of incomplete integration, and s is a Laplace operator.

$$u_{RCV3}=\frac{k_{RCV}}{s+\epsilon} \tag{17}$$

The addition unit 107 adds the compensation amount $u_{RCV3}$ to the opening degree command value of the circulation flow regulation valve V1 calculated by the addition unit 106, and calculates a final opening degree command value $u_{RCV2}$ of the circulation flow regulation valve V1. The surging control device 40C outputs the opening degree command value $u_{RCV2}$ to the circulation flow regulation valve V1.

(Operation of Control Device)

Next, the control of the circulation flow regulation valve V1 at the time of surging detection will be described with reference to FIGS. 8 and 9.

Figure 9:
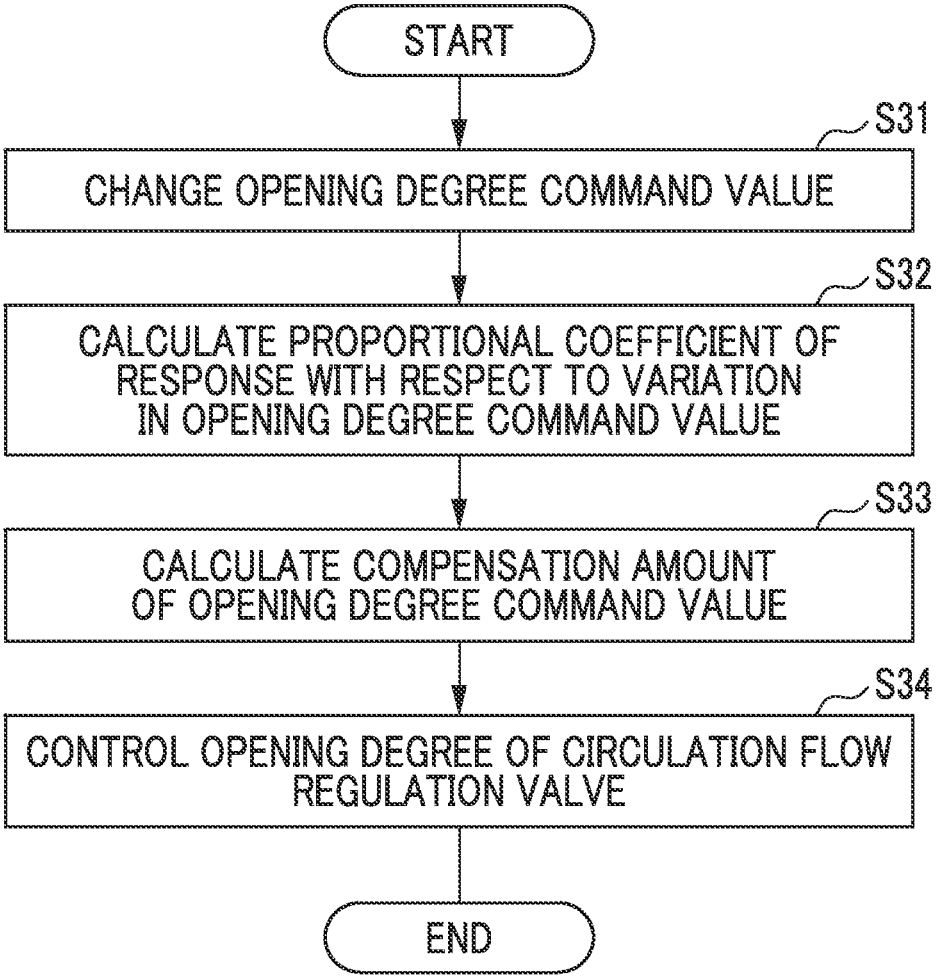
FIG. 9 is a diagram showing an example of an operation of the control device according to the fourth embodiment.

FIG. 9 is a diagram showing an example of the operation of the control device according to the fourth embodiment.

As a premise, it is assumed that surging has occurred and the circulation flow regulation valve V1 is opened at a predetermined opening degree. Alternatively, it is assumed that a relationship between the discharge pressure of the compressor 1 or the pressure ratio before and after the compressor 1, and the flow rate of the refrigerant belongs to the surging region. It is assumed that the control in the first embodiment or the second embodiment is executed in parallel. While the circulation flow regulation valve V1 is open, the surging control device 40C repeatedly and continuously executes the following processes at a predetermined control cycle.

First, the surging control device 40C changes the opening degree command value, which is sent to the circulation flow regulation valve V1 (step S31). The opening degree variation command unit 41C calculates the opening degree variation command value by using Equation (14). The addition unit 106 adds the opening degree variation command value to the opening degree command value $u_{RCV}$ calculated by the control in the first embodiment or the second embodiment.

Next, the surging control device 40C calculates a proportional coefficient of the response with respect to the variation in the opening degree command value (step S32). First, the variation calculation unit 43C calculates the variation (the variance) of the parameter by using Equation (5). Next, the proportional coefficient calculation unit 44C derives Equation (16) by using Equations (15A) and (15B) and calculates the proportional coefficient $K_{RCVyi}$ by using Equation (16). The proportional coefficient calculation unit 44C outputs the proportional coefficient $K_{RCVyi}$ to the opening degree command value calculation unit 45C.

Next, the surging control device 40C calculates the compensation amount of the opening degree command value (step S33). First, the opening degree command value calculation unit 45C calculates the opening degree command value $u_{RCV1}$ based on the proportional coefficient $K_{RCVyi}$ and the function 452. Next, the delay phase compensation unit 46C calculates the compensation amount $u_{RCV3}$ by using Equation (17).

Next, the surging control device 40C controls the opening degree of the circulation flow regulation valve V1 (step S34). The addition unit 107 adds the compensation amount $u_{RCV3}$ to the opening degree command value including the variation component calculated in step S31 and calculates the opening degree command value $u_{RCV2}$. The surging control device 40C outputs the opening degree command value $u_{RCV2}$ to the circulation flow regulation valve V1.

According to the present embodiment, the opening degree of the circulation flow regulation valve V1 can be controlled to a minimum opening degree necessary for suppressing surging when surging occurs, so that work loss due to the compressor 1 can be suppressed.

The fourth embodiment can be combined with the first embodiment to the third embodiment. For example, by combining the first embodiment or the second embodiment, the third embodiment, and the fourth embodiment, the angle of the inlet guide vane (LP) 2*a* and the inlet guide vane (HP) 2*b*, and the flow rate of the refrigerant flowing through the circulation flow pipe P4 are optimized, thereby surging can be avoided or the degree of surging can be suppressed. When the rotation speed of the compressor 1, the angle of the inlet guide vane (LP) 2*a* or the like, and the opening degree of the circulation flow regulation valve V1 are simultaneously adjusted, values of a cycle T for changing the compressor rotation speed, a cycle $T_{IGV}$ for changing the inlet guide vane angle, and a cycle $T_{RCV}$ for changing the circulation flow rate must be different from each other. For example, it is desirable to set the short cycles in order from the one with the fastest response, such as T for 3 seconds, $T_{IGV}$ for 15 seconds, and $T_{RCV}$ for 75 seconds, and set the other cycle to an integral multiple of the shortest cycle.

Figure 11:
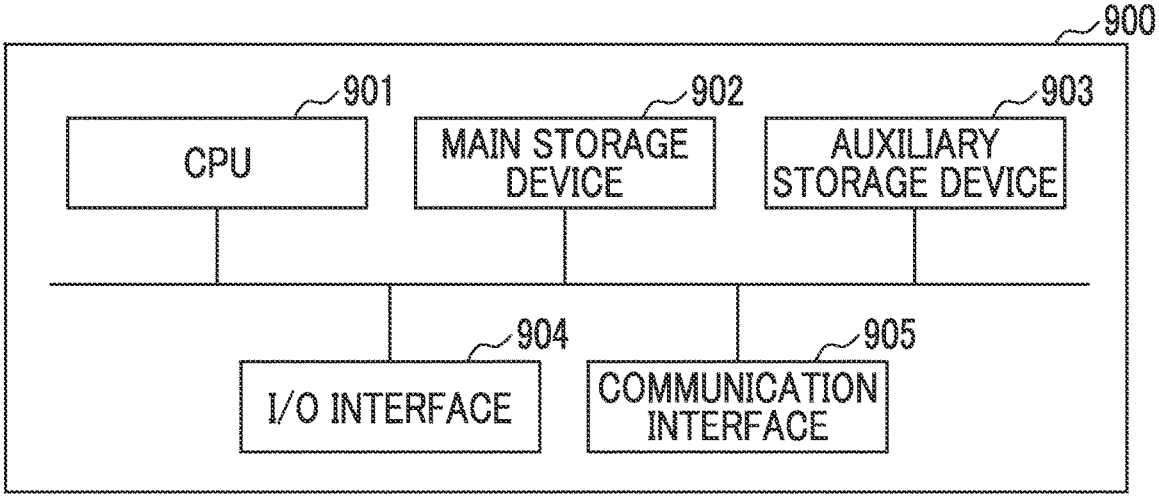
FIG. 11 is a diagram showing an example of a hardware configuration of the control device according to each embodiment.

FIG. 11 is a diagram showing an example of a hardware configuration of the control device according to each embodiment.

A computer 900 includes a CPU 901, a main storage device 902, an auxiliary storage device 903, an I/O interface 904, and a communication interface 905.

The above-described compressor output control devices 10 and 10B, and surging control devices 40, 40A, 40B, and 40C are mounted on the computer 900. Further, the above-mentioned each function is stored in the auxiliary storage device 903 in the form of a program (or instructions). The CPU 901 reads the program from the auxiliary storage device 903, loads the program into the main storage device 902, and executes the above processes according to the program. The CPU 901 ensures a storage area in the main storage device 902 according to the program. The CPU 901 ensures a storage area for storing the data being processed in the auxiliary storage device 903 according to the program.

A program (or instructions) for implementing all or a part of the functions of the compressor output control device 10 and 10B, and the surging control device 40, 40A, 40B, and 40C may be recorded on a computer-readable recording medium, and the program recorded on the recording medium may be read by a computer system and executed to perform processes by each functional unit. The term "computer system" as used herein includes hardware such as an OS or peripheral devices. The "computer system" is also assumed to include a homepage providing environment (or display environment) when a WWW system is used. The "computer-readable recording medium" refers to a portable medium such as a CD, DVD, or USB, or a storage device such as a hard disk built in the computer system. When this program is distributed to the computer 900 by using a communication line, the computer 900, which is received the distribution of the program, may load the program into the main storage device 902 and execute the above processes. The above-mentioned program may be a program (or instructions) for implementing a part of the above-mentioned functions and further implementing the above-mentioned functions in combination with a program (or instructions) already recorded in the computer system.

As described above, some embodiments according to the present disclosure have been described, but all of these embodiments are presented as examples and are not intended to limit the scope of the invention. These embodiments can be implemented in various other forms, and various omissions, replacements, and changes can be made without departing from the gist of the invention. These embodiments and variations thereof are included in the scope of the invention described in the claims and the equivalent scope thereof, as are included in the scope and gist of the invention.

<Additional Notes>

The control device, the control method, and the storage medium described in each embodiment are ascertained as follows, for example.

(1) A control device (the compressor output control devices 10 and 10B, the surging control devices 40 to 40C) according to a first aspect includes: a variation command unit (the rotation speed variation command unit 41, the angle variation command unit 41B, the opening degree variation command unit 41C) that changes a command value (the rotation speed, the opening degree of IGV, the opening degree of the circulation flow regulation valve), which is a command value sent to a system (the chilling system 100) including a compressor (1, 1*a*, 1*b*), affecting an operating state of the compressor (1, 1*a*, 1*b*); a proportional coefficient calculation unit (44, 44A, 44B, 44C) that calculates a proportional coefficient of a variation in a parameter, which indicates a state of the compressor or an electric motor 30 that drives the compressor when the system is operated based on the command value, with respect to the command value; and a control unit (the delay phase compensation units 46 and 46B, the subtraction unit 105*a*, the addition unit 105*b*, the addition unit 107) that performs control for avoiding or suppressing surging in the compressor, based on a value of the proportional coefficient.

The command value that affects the operating state of the compressor is made to be changed, the response of the variation in the command value is measured, and the proportional coefficient of the measured variation in the parameter with respect to the variation in the command value is calculated. Thereafter, the control is performed in which the operating state of the compressor is shifted to an operating point where surging is avoided, according to the magnitude of the proportional coefficient. As a result, surging can be quickly avoided even when surging is likely to occur, and surging can be quickly suppressed even when surging occurs.

(2) The control device (the compressor output control device 10, the surging control device 40A) according to a second aspect is the control device in (1), in which the proportional coefficient calculation unit 44A calculates the proportional coefficient for each of a plurality of the parameters, and the control unit performs control for avoiding or suppressing surging in the compressor, based on values of a plurality of the proportional coefficients.

Control reliability can be improved by performing the control for avoiding surging based on the plurality of parameters.

(3) The control device (the compressor output control device 10, the surging control devices 40 and 40A) according to a third aspect is the control device in (1) or (2), in which the command value is a rotation speed command value of the compressor, and the variation command unit periodically changes the rotation speed command value, the proportional coefficient calculation unit calculates the proportional coefficient when the rotation speed command value is periodically changed, and the control unit performs control for increasing a flow rate of fluid sucked and discharged by the compressor, according to a magnitude of the proportional coefficient.

By changing the rotation speed of the compressor, which most affects surging, and monitoring the response of the variation in the rotation speed, surging can be detected with high accuracy.

(4) The control device (the compressor output control devices 10 and 10B, the surging control devices 40 and 40B) according to a fourth aspect is the control device in any one of (1) to (3), in which the system includes a plurality of the compressors, and an inlet guide vane that controls a flow rate of fluid sucked by the compressor is provided for each of the compressors, the command value is an angle command value of the inlet guide vane, and the variation command unit periodically changes the angle command value, the proportional coefficient calculation unit calculates the proportional coefficient when the angle command value is periodically changed and the control unit performs control for adjusting the angle command value for each of the inlet guide vanes such that work loads of the plurality of compressors are equalized according to a magnitude of the proportional coefficient.

As a result, in a system including the plurality of compressors, even in a case where the rotation speed of each compressor cannot be individually controlled, surging can be avoided by individually controlling the inlet guide vanes.

(5) The control device (the compressor output control devices 10 and 10B, the surging control devices 40 and 40B) according to a fifth aspect is the control device in (4), in which for the plurality of compressors, the control unit (the subtraction unit 105*a*, the addition unit 105*b*) changes the inlet guide vane, which is provided in the compressor having a lower probability that surging occurs, such that the work load of the compressor is increased.

When the risk of surging increases in one of the compressors, the opening degree of IGV of the compressor having a lower probability that surging occurs is increased. As a result, the loads among each of the compressors can be made equal, and the margin with the surge line can be made equal.

(6) The control device (the compressor output control devices 10 and 10B, the surging control devices 40 to 40C) according to a sixth aspect is the control device in any one of (1) to (5), in which the command value is an opening degree command value of a flow regulation valve, which is provided in a pipe connecting a suction side and a discharge side of the compressor, and the variation command unit periodically changes the opening degree command value, the proportional coefficient calculation unit calculates the proportional coefficient when the opening degree command value of the flow regulation valve is periodically changed, and the control unit performs control for adjusting the opening degree command value according to a magnitude of the proportional coefficient.

When surging occurs, the control is performed in which surging is suppressed such that the flow regulation valve provided in the pipe connecting the suction side and the discharge side of the compressor is opened, and the opening degree of the flow regulation valve can be optimized by changing the opening degree of the flow regulation valve during the control and adjusting the opening of the flow regulation valve based on the response of the variation in the opening degree. For example, the opening degree of the flow regulation valve can be minimized.

Figure 10:
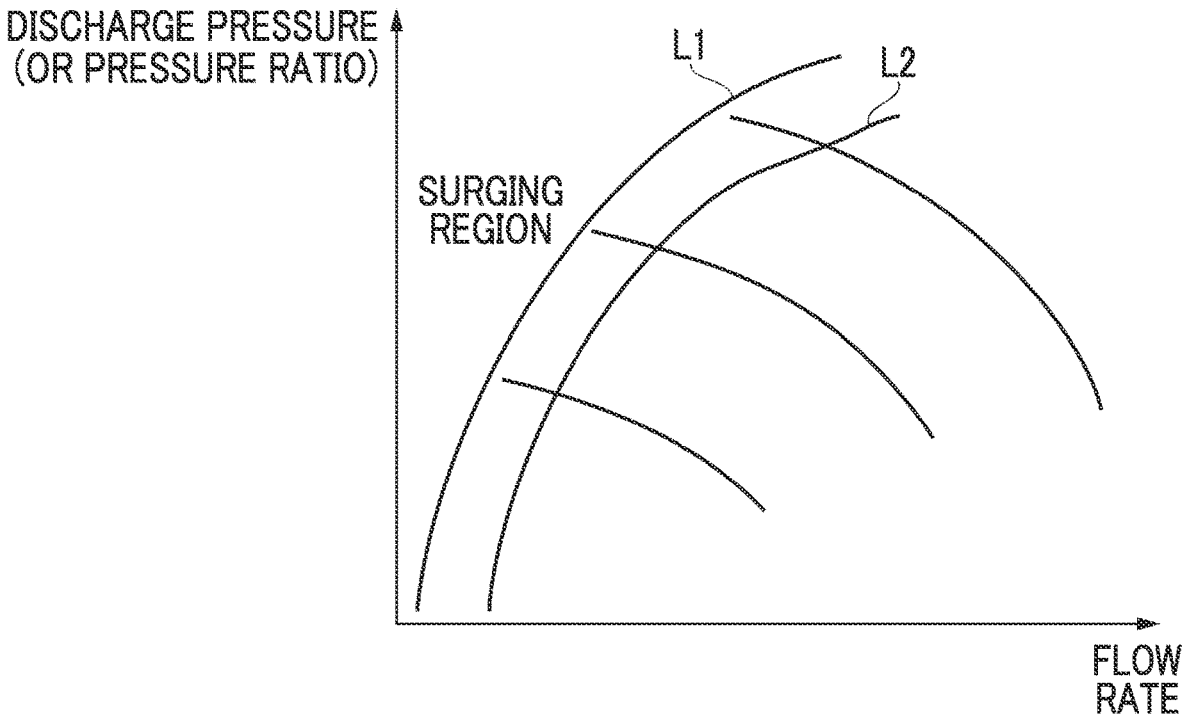
FIG. 10 is a diagram describing a surging line.

(7) The control device according to a seventh aspect is the control device in (6), in which a process described in (6) is performed when a relationship between discharge pressure of the compressor or a pressure ratio before and after the compressor, and a flow rate of fluid sucked and discharged by the compressor, is in a relationship (the relationship of the region on the left side of the surge line L1 in FIG. 10) in which there is a high probability that a predetermined surging occurs.

By performing the process described in (6) under the operation condition in which surging occurs, the opening degree of the flow regulation valve can be quickly optimized.

(8) The control device (the compressor output control devices 10 and 10B, the surging control devices 40 to 40C) according to an eighth aspect is the control device in any one of (1) to (7), in which the parameter is at least one of a rotation speed of the compressor, vibration of the compressor, a current flowing through the compressor, a flow rate of fluid sucked and discharged by the compressor, pressure of the fluid, a pressure ratio of the fluid before and after the compressor, a rotation speed of the electric motor, vibration of the electric motor, a current flowing through the electric motor, power consumed by the electric motor, and periphery noise.

Since the control method according to (1) to (7) can be executed by using the various parameters described above, a parameter that is easy to measure can be used.

(9) A control device according to a ninth aspect includes: a variation command unit that changes a command value, which is a command value sent to a system including a compressor, affecting an operating state of the compressor; a proportional coefficient calculation unit that calculates a proportional coefficient of a variation in a parameter, which indicates a state of the compressor or an electric motor that drives the compressor when the system is operated based on the command value, with respect to the command value; and a detection unit (the opening degree command value calculation units 45 to 45C) that detects surging in the compressor based on a value of the proportional coefficient.

The command value that affects the operating state of the compressor is made to be changed, the response of the variation in the command value is measured, and the proportional coefficient of the measured variation in the parameter with respect to the variation in the command value is calculated. Thereafter, the occurrence of surging is detected based on the magnitude of the proportional coefficient. As a result, the occurrence of surging can be detected early and reliably.

(10) A control method according to a tenth aspect includes: changing a command value, which is a command value sent to a system including a compressor, affecting an operating state of the compressor; calculating a proportional coefficient of a variation in a parameter, which indicates a state of the compressor or an electric motor that drives the compressor when the system is operated based on the command value, with respect to the command value; and performing control for avoiding or suppressing surging in the compressor, based on a value of the proportional coefficient.

(11) A non-transitory computer-readable storage medium storing a program according to an eleventh aspect causes a computer 900 to execute a process of changing a command value, which is a command value sent to a system including a compressor, affecting an operating state of the compressor, calculating a proportional coefficient of a variation in a parameter, which indicates a state of the compressor or an electric motor that drives the compressor when the system is operated based on the command value, with respect to the command value, and performing control for avoiding or suppressing surging in the compressor, based on a value of the proportional coefficient.

INDUSTRIAL APPLICABILITY

According to the control device, the control method, and the storage medium described above, surging can be detected and handled quickly and reliably.

REFERENCE SIGNS LIST

100, 100B: chilling system
1: compressor
1*a*: compressor (LP)
1*b*: compressor (HP)
2: inlet guide vane
2*a*: inlet guide vane (LP)
2*b*: inlet guide vane (HP)
3: condenser
4: evaporator
P1, P2, P3, 11, 12: pipe
P4: circulation flow pipe
V1: circulation flow regulation valve
G1: pressure sensor
N1: noise meter
10: compressor output control device
20: variable speed drive device
30: electric motor
40, 40A, 40B, 40C: surging control device
41: rotation speed variation command unit
41B: angle variation command unit
41C: opening degree variation command unit
42: subtraction unit
43, 43A, 43B, 43C: variation calculation unit
44, 44A, 44B, 44C: proportional coefficient calculation unit
45, 45A, 45C: opening degree command value calculation unit
46, 46C: delay phase compensation unit
47A: weighted sum calculation unit
48B: compensation amount calculation unit
101: rotation speed command unit
102: addition unit
103*a*: angle command unit (LP)
103*b*: angle command unit (HP)
104*a*: addition unit
104*b*: subtraction unit
105*a*: subtraction unit
105*b*: addition unit
106, 107: addition unit
900: computer
901: CPU
902: main storage device
903: auxiliary storage device
904: I/O interface
905: communication interface

The invention claimed is:

1. A control device comprising:
a central processing unit (CPU) that:
changes a command value that is sent to a system including a compressor and affects an operating state of the compressor,
calculates a proportional coefficient of a variation in a parameter that indicates a state of the compressor or an electric motor that drives the compressor when the system is operated based on the command value, with respect to the command value, and
performs control for avoiding or suppressing surging in the compressor, based on a value of the proportional coefficient, wherein
the command value is a rotation speed command value of the compressor, and
the CPU further:
changes the rotation speed command value on a time basis during each cycle of the compressor,
calculates the proportional coefficient when the rotation speed command value is changed, and
performs control for increasing a flow rate of fluid sucked and discharged by the compressor, according to a magnitude of the proportional coefficient.

2. The control device according to claim 1, wherein the parameter is one of multiple different parameters, and
the CPU further:
calculates the proportional coefficient for each of a plurality of the parameters, and
performs control for avoiding or suppressing surging in the compressor, based on values of a plurality of the proportional coefficients.

3. The control device according to claim 1, wherein
the parameter is at least one of a rotation speed of the compressor, vibration of the compressor, a current flowing through the compressor, the flow rate of fluid sucked and discharged by the compressor, pressure of the fluid, a pressure ratio of the fluid before and after the compressor, a rotation speed of the electric motor, vibration of the electric motor, a current flowing through the electric motor, power consumed by the electric motor, and periphery noise.

4. A control device comprising:

a central processing unit (CPU) that:

changes a command value that is sent to a system including a compressor and affects an operating state of the compressor, calculates a proportional coefficient of a variation in a parameter that indicates a state of the compressor or an electric motor that drives the compressor when the system is operated based on the command value, with respect to the command value, and detects surging in the compressor based on a value of the proportional coefficient, wherein the command value is a rotation speed command value of the compressor, and the CPU further:

periodically changes the rotation speed command value on a time basis during each cycle of the compressor, calculates the proportional coefficient when the rotation speed command value is changed, and detects the surging in the compressor according to a magnitude of the proportional coefficient.

* * * * *